US006688410B1

(12) United States Patent
Singh et al.

(10) Patent No.: US 6,688,410 B1
(45) Date of Patent: Feb. 10, 2004

(54) HYDRO-LIFTER ROCK BIT WITH PDC INSERTS

(75) Inventors: Amardeep Singh, Houston, TX (US); Quan V. Nguyen, Houston, TX (US); Sujian Huang, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/589,260

(22) Filed: Jun. 7, 2000

(51) Int. Cl.[7] ..... E21B 10/46; E21B 10/16
(52) U.S. Cl. ..... 175/374; 175/339; 175/408
(58) Field of Search ..... 175/374, 408, 175/406, 426, 339

(56) References Cited

U.S. PATENT DOCUMENTS

| | | | | |
|---|---|---|---|---|
| 3,344,870 A | * | 10/1967 | Morris | 175/374 |
| 4,140,189 A | | 2/1979 | Garner | 175/329 |
| 4,167,980 A | * | 9/1979 | Saxman | 175/374 |
| 4,444,281 A | | 4/1984 | Schumacher, Jr. et al. | 175/336 |
| 4,591,008 A | | 5/1986 | Oliver | 175/227 |
| 4,936,398 A | | 6/1990 | Auty et al. | 175/336 |
| 5,064,007 A | | 11/1991 | Kaalstad | 175/334 |
| 5,074,367 A | * | 12/1991 | Estes | 175/374 |
| 5,145,016 A | * | 9/1992 | Estes | 175/331 |
| 5,289,889 A | | 3/1994 | Gearhart et al. | 175/325 |
| 5,494,123 A | * | 2/1996 | Nguyen | 175/408 |
| 5,553,681 A | * | 9/1996 | Huffstutler et al. | 175/339 |
| 5,697,462 A | | 12/1997 | Grimes et al. | 175/374 |
| 5,709,278 A | | 1/1998 | Crawford | 178/331 |
| 5,746,280 A | | 5/1998 | Scott et al. | 175/374 |
| 5,755,301 A | * | 5/1998 | Love et al. | 175/426 |
| 5,839,526 A | | 11/1998 | Cisneros et al. | 175/374 |
| 5,862,871 A | | 1/1999 | Curlett | 175/340 |
| 5,890,550 A | * | 4/1999 | Swadi et al. | 175/374 |
| 5,996,713 A | | 12/1999 | Pessier et al. | 175/353 |
| 6,123,160 A | * | 9/2000 | Tibbitts | 175/385 |
| 6,173,797 B1 | * | 1/2001 | Dykstra et al. | 175/374 |
| 6,227,314 B1 | * | 5/2001 | Zadrapa et al. | 175/331 |

FOREIGN PATENT DOCUMENTS

| | | |
|---|---|---|
| GB | 2 309 242 | 7/1997 |
| GB | 2 349 661 | 8/2000 |

OTHER PUBLICATIONS

U.K. Search Reprot for Appln. No. GB 0113771.0 Dated Oct. 31, 2001; (3 pp).

* cited by examiner

*Primary Examiner*—Hoang Dang
(74) *Attorney, Agent, or Firm*—Conley Rose, P.C.

(57) ABSTRACT

A novel rolling cone rock bit includes a plurality of PDC or other cutters mounted to the leg of the drill bit and positioned to cut the troublesome corner of the bottomhole. The plurality of cutters may be the primary cutting component at gage diameter, or may be redundant to gage teeth on a rolling cutter that cut to gage diameter. Consequently, the occurrence of undergage drilling from the wear and failure of the gage row on a rolling cutter is lessened. Another inventive feature is the inclusion of a mud ramp that creates a large junk slot from the borehole bottom up the drill bit. The resulting pumping action of the drill bit ramp speeds up the removal of chips or drilling cuttings from the bottom of the borehole, reduces the level of hydrostatic pressure at the bottom of the borehole and minimizes the wearing effect of cone inserts regrinding damaging drill cuttings.

50 Claims, 22 Drawing Sheets

HYDRO-LIFTER ROCK BIT WITH PDC INSERTS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

Rock bits, referred to more generally as drill bits, are used in earth drilling. Two predominant types of rock bits are roller cone rock bits and shear cutter bits. Shear cutter bits are configured with a multitude of cutting elements directly fixed to the bottom, also called the face, of the drill bit. The shear bit has no moving parts, and its cutters scrape or shear rock formation through the rotation of the drill bit by an attached drill string. Shear cutter bits have the advantage that the cutter is continuously in contact with the formation and see a relatively uniform loading when cutting the gage formation. Furthermore, the shear cutter is generally loaded in only one direction. This significantly simplifies the design of the shear cutter and improves its robustness. However, although shear bits have been found to drill effectively in softer formations, as the hardness of the formation increases it has been found that the cutting elements on the shear cutter bits tend to wear and fail, affecting the rate of penetration (ROP) for the shear cutter bit.

In contrast, roller cone rock bits are better suited to drill through harder formations. Roller cone rock bits are typically configured with three rotatable cones that are individually mounted to separate legs. The three legs are welded together to form the rock bit body. Each rotatable cone has multiple cutting elements such as hardened inserts or milled inserts (also called "teeth") on its periphery that penetrate and crush the formation from the hole bottom and side walls as the entire drill bit is rotated by an attached drill string, and as each rotatable cone rotates around an attached journal. Thus, because a roller cone rock bit combines rotational forces from the cones rotating on their journals, in addition to the drill bit rotating from an attached drill string, the drilling action downhole is from a crushing force, rather than a shearing force. As a result, the roller cone rock bit generally has a longer life and a higher rate of penetration through hard formations.

Nonetheless, the drilling of the borehole causes considerable wear on the inserts of the roller cone rock bit, which affects the drilling life and peak effectiveness of the roller cone rock bit. This wear is particularly severe at the corner of the bottom hole, on what is called the "gage row" of cutting elements. The gage row cutting elements must both cut the bottom of the wellbore and cut the sidewall of the borehole. FIG. 1 illustrates a cut-away view of a conventional arrangement for the inserts of a roller cone rock bit. A cone 110 rotates around a journal 120 attached to a rock bit leg 108. The cone 110 includes inserts 112 that cut the borehole bottom 150 and sidewall 155.

The inserts 115 cutting the rock formation are the focus for the damaging forces that exist when the drill bit is reaming the borehole. The gage row insert 115 at the corner of the bottom 150 and sidewall 155 is particularly prone to wear and breakage, since it has to cut the most formation and because it is loaded both on the side when it cuts the bore side wall and vertically when it cuts the bore bottom. The gage row inserts have the further problem that they are constantly entering and leaving the formation that can cause high impact side loadings and further reduce insert life. This is especially true for directional drilling applications where the drill bit is often disposed from absolute vertical.

The wear of the inserts on the drill bit cones results not only in a reduced ROP, but the wear of the corner inserts results in a borehole that is "under gage" (i.e. less than the full diameter of the drill bit). Once a bit is under gage, it is must be removed from the hole and replaced. Further, because it is not always apparent when a bit has gone under gage, an undergage drill bit may be left in the borehole too long. The replacement bit must then drill through the under gage section of hole. Since a drill bit is not designed to ream an undergage borehole, damage may occur to the replacement bit, especially at the areas most likely to be short-lived and troublesome to begin with. This decreases its useful life in the next section. Because this can result in substantial expense from lost drill rig time as well as the cost of the drill bit itself, the wear of the inserts at the corner of the rolling cone rock bit is highly undesirable.

Another cause of wear to the inserts on a rock bit is the inefficient removal of drill cuttings from the bottom of the well bore. Both roller cone rock bits and shear bits generate rock fragments known as drill cuttings. These rock fragments are carried uphole to the surface by a moving column of drilling fluid that travels to the interior of the drill bit through the center of an attached drill string, and is ejected from the face of the drill bit. The drilling fluid then carries the drill cuttings uphole through an annulus formed by the outside of the drill string and the borehole wall. In certain types of formations the rock fragments may be particularly numerous, large, or damaging, and accelerated wear and loss or breakage of the cutting inserts often occurs. This wear and failure of the cutting elements on the rock bit results in a loss of bit performance by reduced penetration rates and eventually requires the bit to be pulled from the hole.

Inefficient removal of drilling fluid and drill cuttings from the bottom hole exacerbates the wear and failure of the cutting elements on the roller cones because the inserts impact and regrind cuttings that have not moved up the bore toward the surface. Erosion of the cone shell (to which the inserts or teeth attach) can also occur in a roller cone rock bit from drill cuttings when the bit hydraulics are inappropriately directed, leading to cracks and damage to the shell. Ineffective removal of drilling fluid and drill cuttings can further result in premature failure of the seals in a rock bit from a buildup of drill cuttings and mud slurry in the area of the seal. Wear also occurs to the body of the drill bit from the constant scraping and friction of the drill bit body against the borehole wall.

It would be desirable to design a drill bit that combines the advantages of a shear cutter rock bit with those of a roller cone rock bit. It would additionally be desirable to design a longer lasting drill bit that minimizes the effect of drill cuttings on the drill bit. This drill bit should also minimize the downhole wear occurring from the scraping of the drill bit against the borehole wall.

SUMMARY OF THE INVENTION

In one embodiment, the invention is a rolling cone rock bit including a body, a leg formed from the body with an attached rolling cone, and a plurality of cutting elements mounted to the backface of the leg, the plurality of cutting elements having at least one cutting element extending to the gage diameter of the drill bit. Preferably, at least a majority of the cutting tips of the cutting elements extend to gage diameter. The cutting elements may be disposed in a curved row on the leading edge of the leg. This arrangement may similarly be constructed on a second leg of the drill bit, in which case it is preferred that the cutting elements on the first leg are staggered with respect to the cutting elements on the second leg to result in overlapping cutting elements in rotated profile. The drill bit may also include a mud ramp surface for the flow of drilling fluid from the bottom of a wellbore. The cutting elements of the rolling cone cutters may be of any suitable cutting design, and may or may not extend to gage diameter. In addition, the drill bit may have inserts around its periphery to protect the body of the drill bit and to stabilize the drill bit.

In another embodiment, the invention is a rolling cone rock bit with a bit body and attached rolling cone, and a junk slot, defined by the bit body and a junk slot boundary line, wherein the junk slot has a cross-sectional area at each height along the junk slot with the area at the top of the junk slot being greater than the area at its bottom. The cross-sectional area at the top may be at least 15% greater at its top than at its bottom, it may be at least 100% greater, or it may be somewhere in the range of 15% to 600% greater. The drill bit may include a leg with a mud ramp, and the mud ramp then forms one boundary of the junk slot. The drill bit may also include a nozzle boss that forms a boundary for the junk slot, where the cross-sectional area of the junk slot is greater at the top of the mud ramp than at the bottom of the nozzle boss. The junk slot boundary may be formed by the rotational movement of an outermost point on the leg. The mud ramp may be comprised of two or more straight sections at angles from the longitudinal axis of the drill bit, or may be a set of curves such as convex or concave.

In yet another embodiment, the invention is a drill bit with at least one leg forming a mud ramp. The mud ramp has a first portion corresponding to a first angle and a second portion corresponding to a second angle, with the first angle and the second angle being different. The first portion may be a straight section, the second portion may be a straight section, the first portion may be a curve with the angle being measured with respect to a tangent to the curve at the point, and the second portion may be a curve with the angle being measured with respect to a tangent to that point.

Thus, the invention comprises a combination of features and advantages which enable it to overcome various problems of prior drill bits. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENT

Figure 2:
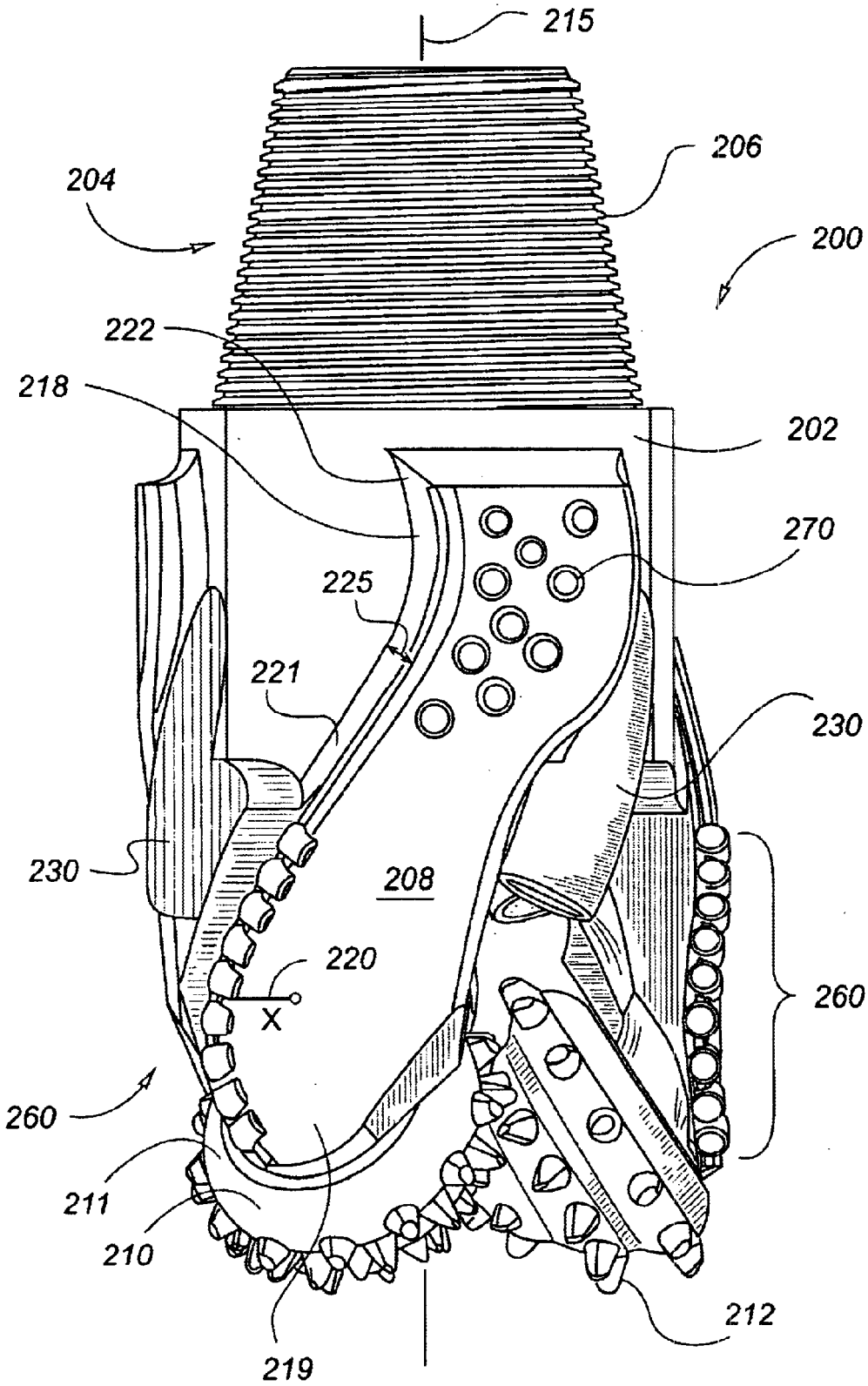
FIG. 2 is a first embodiment of the invention showing a drill bit having PDC cutters on at least one leg.

The rock bit 200 of FIG. 2 includes a body 202 and an upper end 204 that includes a threaded pin connection 206 for attachment of a drill string used to raise, lower, and rotate bit 200 during drilling. Body 202 includes a number of legs 208, preferably three, each of which includes a mud lifter ramp 218 of width 225, a row of polycrystalline diamond cutters (PDC) 260, and wear resistant inserts 270. Each leg terminates at its lower end with a rotatable cone 210. Each cone 210 comprises a cone shell 211 and rows of cutting elements 212, or inserts, arranged in a generally conical structure. These inserts 212 may be tungsten carbide inserts (TCI) mounted in a pocket or cavity in the cone shell, or may be milled teeth on the face of the cone, as is generally known in the art. Each leg also includes a lubrication system which confines lubricant within bit 200 to reduce the friction in bearings located between rotatable cutters or cones 210 and their respective shafts. Semi-round top stability inserts may be located at a lagging location behind PDC cutters 260.

Bit body 202 defines a longitudinal axis 215 about which bit 200 rotates during drilling. Rotational or longitudinal axis 215 is the geometric center or centerline of the bit about which it is designed or intended to rotate and is collinear with the centerline of the threaded pin connection 206. A shorthand for describing the direction of this longitudinal axis is as being vertical, although such nomenclature is actually misdescriptive in applications such as directional drilling.

Bit 200 also includes at least one nozzle 230, with a single nozzle preferably located between each adjacent pair of legs. Additional centrally located fluid ports (not shown) may also be formed in the drill bit body 202. Each nozzle 230 communicates with a fluid plenum formed in the interior of the drill bit body 202. Drilling fluid travels from the fluid plenum and is ejected from each nozzle 230. Nozzles 230 direct drilling fluid flow from the inner bore or plenum of drill bit 200 to cutters 210 to wash drill cuttings off and away from cutting inserts 216, as well as to lubricate cutting inserts 216. The drilling fluid flow also cleans the bottom of the borehole of drill cuttings and carries them to the surface.

Mud lifter ramp 218 assists in the removal of drilling fluid from the borehole bottom. Mud lifter ramp 218 extends from the bottom of the roller cone leg 208 (proximate the borehole bottom) to the top of the drill bit (near the pin end). The illustrated embodiment also shows a curved lower portion 220 transitioning into a substantially straight middle portion 221. Curved lower portion 220 is a swept curve at any desired severity. Further, although in FIG. 2 middle portion 221 is substantially straight, it may also have a curved profile. Middle portion 221 transitions into upper curved portion 222. Substantially straight middle portion 221 is disposed from vertical by a positive angle γ. It should be understood that these designations are being used to refer to general areas of the mud lifter ramp 218 and are not meant to define precise points along the mud lifter ramp 218.

Each leg 208 of FIG. 2 includes a row of polycrystalline diamond cutters (PDC) 260. As is known to those familiar with drag (i.e. shear cutter) bits, PDC cutters include a cutting wafer formed of a layer of extremely hard material, preferably a synthetic polycrystalline diamond material that is attached to substrate or support member. The wafer is also conventionally known as the "diamond table" of the cutter element. Polycrystalline cubic boron nitride (PCBN) may also be employed in forming the wafer. The support member is a generally cylindrical member comprised of a sintered tungsten carbide material having a hardness and resistance to abrasion that is selected so as to be greater than that of the matrix material or steel of the bit body to which it is attached. One end of each support member is secured within a pocket on the drill bit body by brazing or similar means. The wafer is attached to the opposite end of the support member and forms the cutting face of the cutter element. These PDC cutters 260 are inserted into the leading edge of the lower leg portion of the rock bit and cut the borehole side and bottomhole comer. The PDC cutters 260 have an active cutting edge that removes rock by scraping the formation. Each row of PDC cutting elements 260 is arrayed along a curved path 220 along the lower portion 219 of mud lifter ramp 218. These PDC cutting elements may also extend upward along the leg, up middle portion 221. The particular curve chosen, and its severity, depends on a number of factors, including the contours for the desired mud ramp 218. Nonetheless, although a vertical or flat profile for lower portion 219 and PDC cutter row 260 is possible, it is believed that a non-flat profile for the PDC cutters at lower portion 219, and particularly a sharper, more pointed profile having a sharper curvature 220, will assist the cutting ability of the cutters because of the resultant chisel-like distribution of forces from the PDC cutters shearing the formation.

Figure 6A:
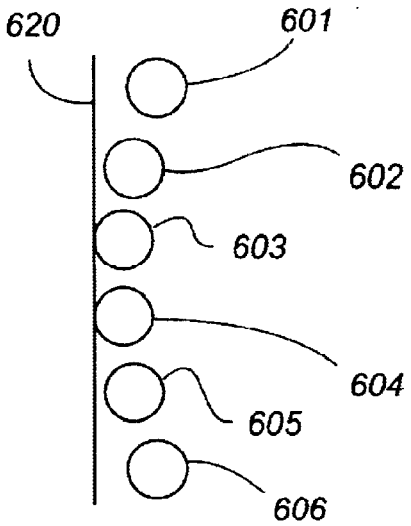
FIGS. 6A–6B show various on-gage and off-gage configurations for PDC leg cutters.
Figure 6B:
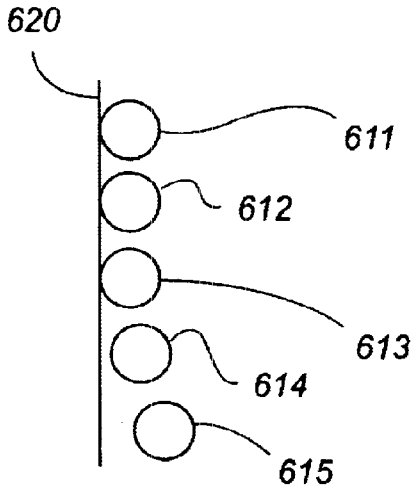

The angle of each PDC cutter is another variable to the design. The individual cutters may be angled perpendicular to the angle of the curve 220 (as shown in FIG. 2), may be perpendicular to the longitudinal axis (as shown in FIGS. 6A and 6B), or may be at some other angle. Further, the size of the PDC cutters are left to the discretion of the drill bit designer, although the width 225 of mud lifter ramp 218 and the size of cutters 260 generally correlate so that larger cutters 260 are used with a larger width 225 and smaller cutters 260 are used with a smaller mud lifter width 225. For example, on a 16" drill bit, 1" cutters may be appropriate, although the invention is certainly not limited to this ratio, and small cutters may be most desirable on large drill bits, or large cutters may be most desirable on small bits depending on formation type and other factors. In addition, FIG. 2 shows numerous wear resistant inserts 270 embedded into the upper portion of the side face to help stabilize the drill bit and to help resist wear of the drill bit body, as well as wear resistant inserts that may be embedded into the portion of the leg backface that trails PDC cutters 260.

Figure 1:
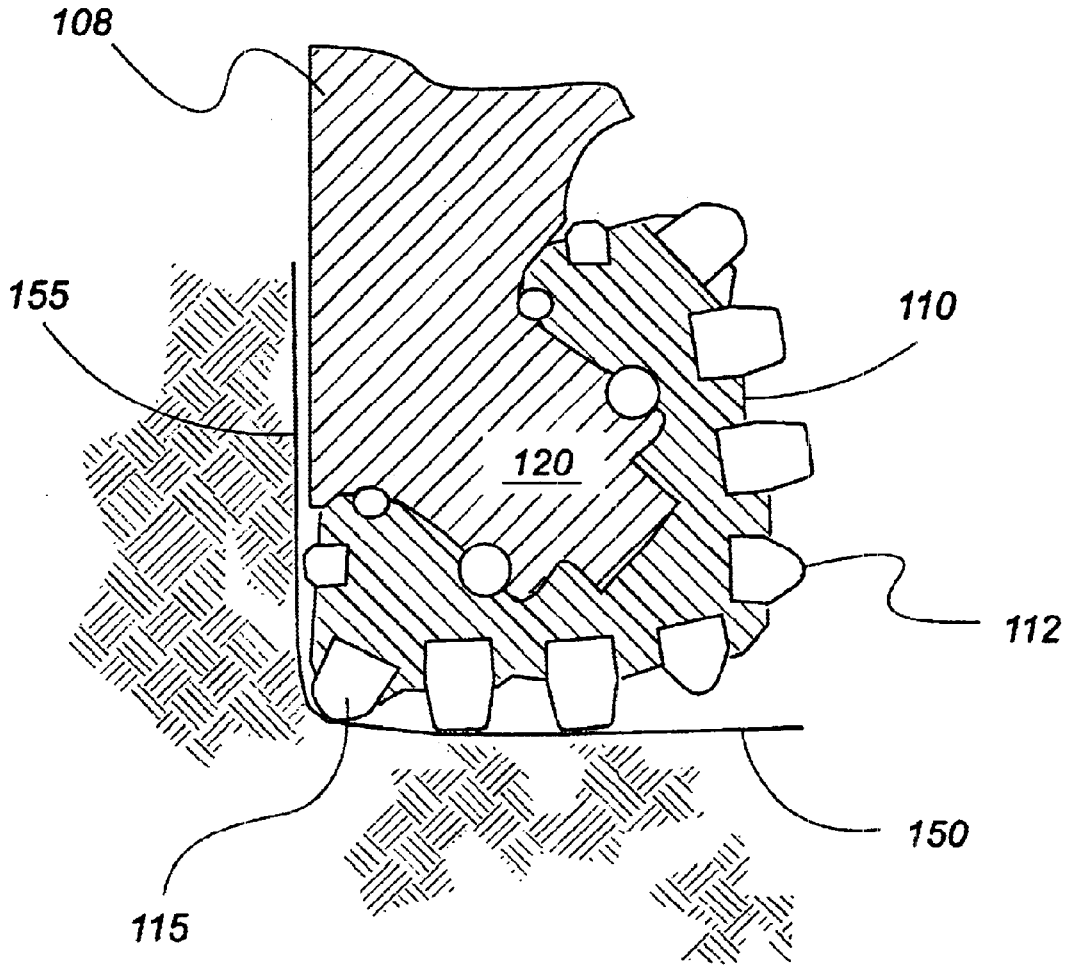
FIG. 1 is a cut away view of a prior art drill bit with a tooth cutting the corner of the borehole bottom.
Figure 3A:
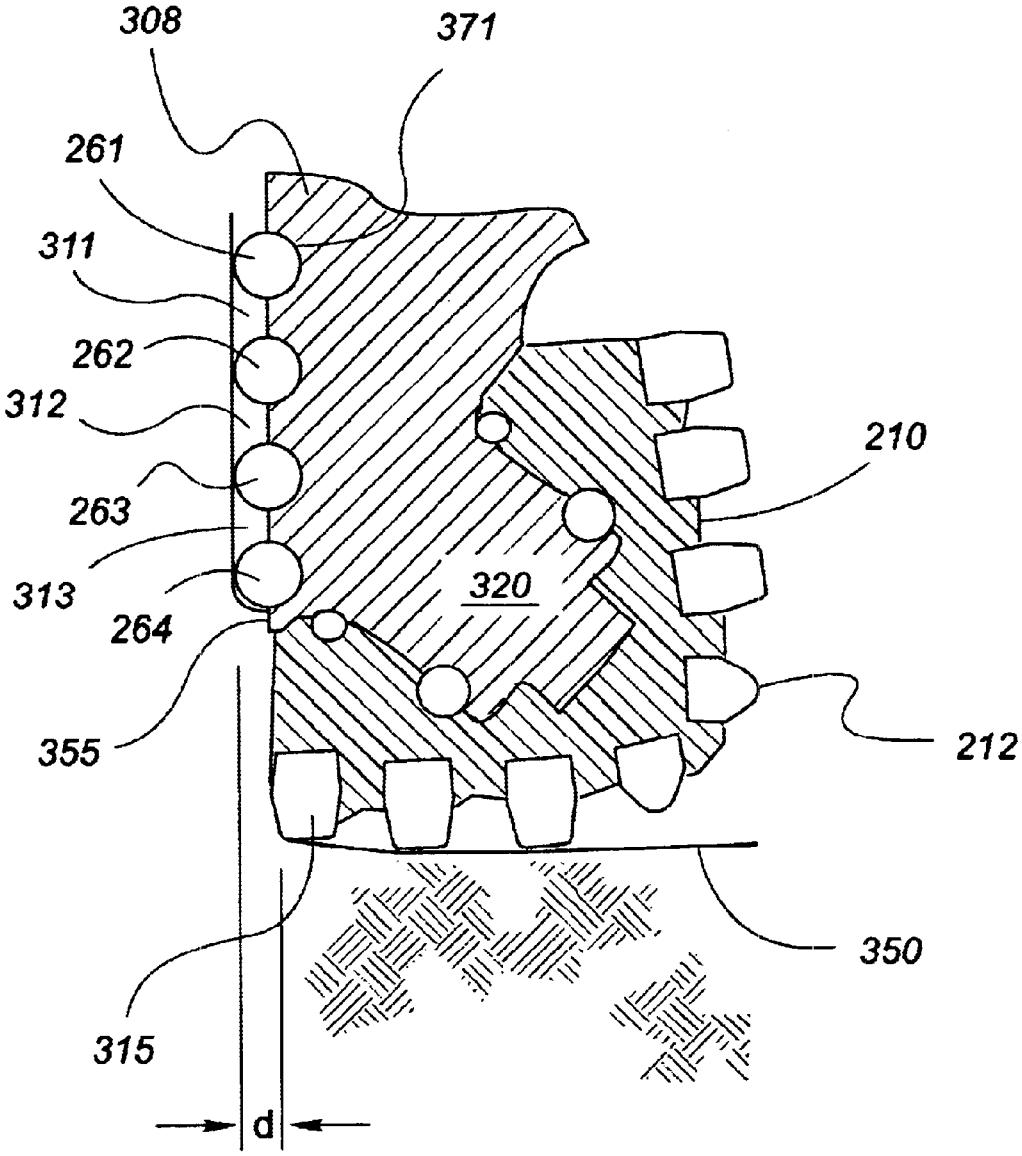
FIG. 3A is a cut away view of a drill bit having PDC leg cutters as the primary gage cutting component.

FIG. 3A shows a cut away view of a leg 208 that forms journal 320. PDC cutters 261–264 each mount in a respective pocket formed in the drill bit leg 308. Cone 210 with inserts 212 rotates about journal 320. Sidewall 355 is collinear with the gage line (i.e. full diameter) of the drill bit in the area proximate the PDC cutters. The cones are preferably designed with inserts that cut inboard of gage thus increasing the life of the outer row of inserts on the cones. Thus, gage row comer cutter 315 is not inclined at an angle to cut the borehole corner (as shown in FIG. 1), but instead is inclined downward to focus its cutting force to the bottom of the borehole. This results in the gage row cutter 315 on the cone offset from gage by a distance "d". The distance "d" may vary from 0" to 1" depending on the bit size and type.

Upon engaging the borehole bottom, inserts 212 crush and scrape the bottom of the borehole, but do little work cutting formation at gage. Thus, the arrangement of FIG. 3A results in a drill bit whose primary cutting component at the gage diameter is the PDC cutters 260, not the inserts 212. This lessens the amount of wear and breakage that occurs on the inserts 212, and preserves the inserts to cut the borehole bottom. Consequently, the bottom of the borehole is reamed by an extended life rolling cone in generally the same manner as a conventional rolling cone cutter. The troublesome corner of the borehole is cut by the series of PDC cutters 261–264. When drilling begins, PDC cutter 264 reams the comer of the borehole bottom at gage. In the event of wear to cutter 264, or the loss of cutter 264 altogether, cutting element 263 is redundantly positioned to take over and cut a comer for the borehole so that it is reamed at full gage diameter. Similarly, if cutter 263 then wears or fails, cutting element 262 is positioned to take over. In fact, these PDC cutter elements are also positioned to also ream the area of the bottomhole covered by cone insert 315 if insert 315 becomes worn. Thus, the drill bit of FIG. 3A is expected to show a significant increase in the longevity of a drill bit to ream a full gage borehole. In addition, this design is expected to be particularly effective when the rows of PDC cutters 260 are arranged to lie along a sharper, more curved line 220 to result in a more pointed profile, as explained above.

Figure 3B:
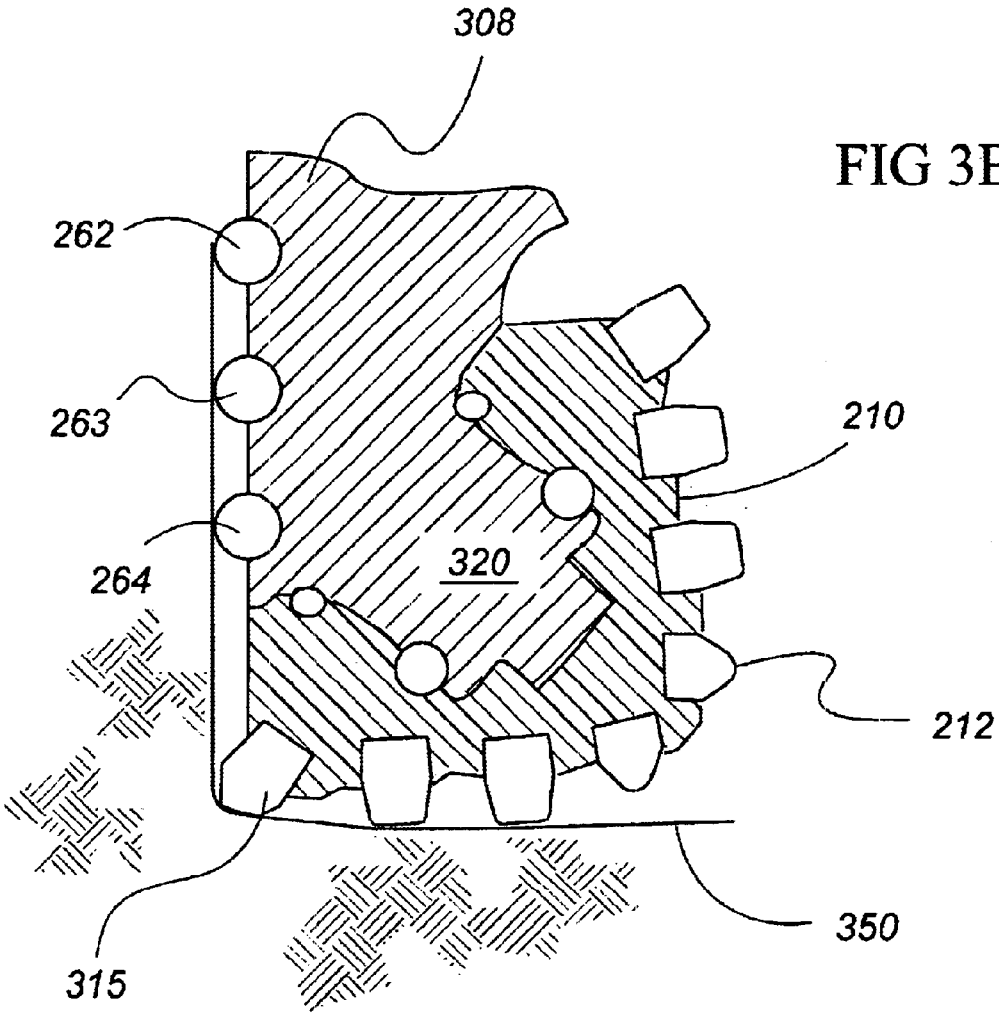
FIG. 3B is a cut away view of a second drill bit having PDC leg cutters at gage.

FIG. 3B is an alternate design showing the cutter insert 315 extending to gage diameter. While generally it is advantageous to have the gage row cutter 315 on the cone offset some distance from gage, even where the gage row cutter 315 extends to gage, PDC cutters 261–264 nonetheless provide numerous backup or redundant cutters to cut the comer of the borehole where gage row cutter 315 becomes worn or breaks. The PDC cutters would then be a secondary cutting component. Consequently, the invention can also be practiced with the gage row cutter 315 and cones cutting to gage diameter as well as the PDC cutters on the leg. This would provide a redundant system to prevent under gage drilling, which is costly to the driller. It should be noted that relative terms such as upward, downward and vertical are intended to describe the relative arrangement of components and are not being used in their absolute sense.

Figure 4:
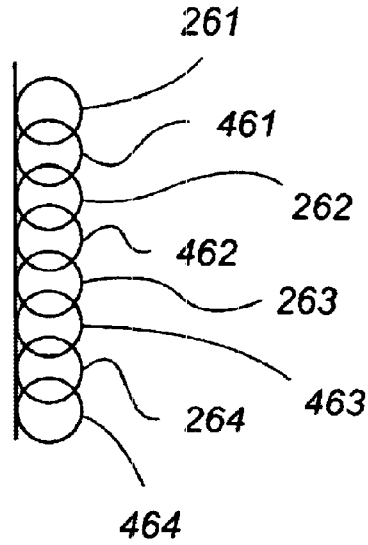
FIG. 4 shows PDC leg cutters in rotated profile.

The PDC cutters 261–264 of FIGS. 3A and 3B are located on the leading edge of a drill hit leg, and include spaces or gaps 311–313 between each pair of PDC cutting elements. These gaps, along with the location of the cutting elements on the leading edge of the bit leg that forms the bottom of the mud ramp, allow drilling fluid to flow over and around the PDC cutters, cooling them and carrying away cuttings. PDC cutting elements on different legs may likewise include gaps between adjacent PDC cutters, but these cutters will be staggered with respect to the PDC cutters on the first leg, resulting in cutter overlap when the PDC cutters are placed into rotated profile. FIG. 4 shows one example (not to scale).

Improved cleaning of the cutting elements is also achieved from the placement of at least certain of the cutting elements below the uppermost tooth of the corresponding roller cone. For example, during the rotation of the rolling cone, only a limited number of the teeth come in contact with the bottom of the borehole at any one time. During the instant a particular tooth on a roller cone is crushing rock formation, there are a corresponding number of teeth distributed on the cone shell that are not in contact with formation. A cutting element such as 264 on the leg of the rolling cone rock bit is therefore disposed below the uppermost tooth of the rolling cone. This low position of cutting elements on a drill bit leg is desirable because of the higher velocity of the hydraulic fluid near the bottom of the borehole, resulting in improved cutting element cleaning.

Figure 5:
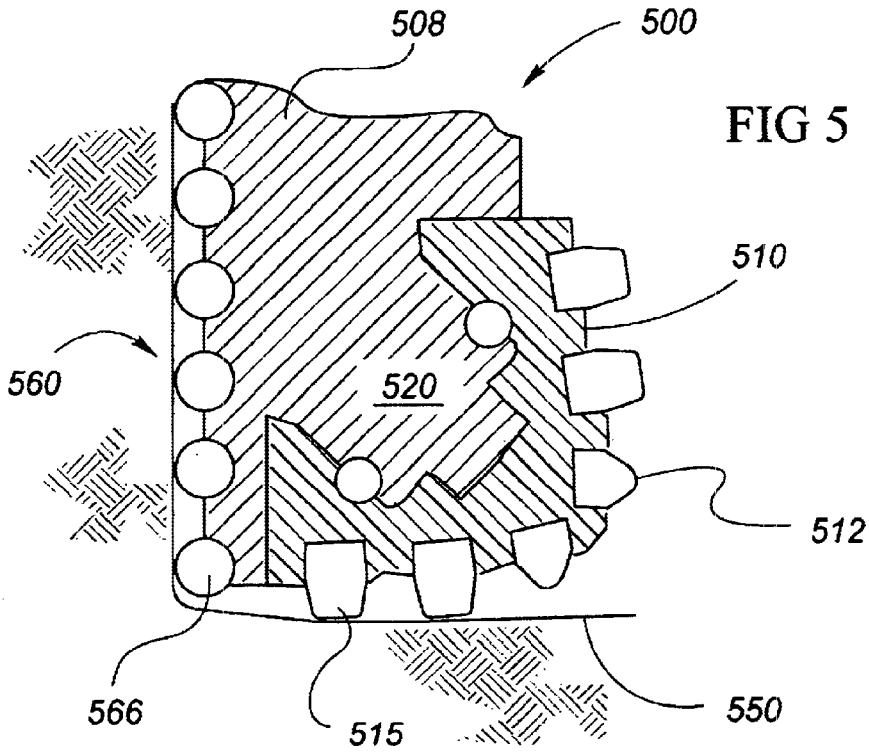
FIG. 5 is a cut away view of a drill bit having PDC leg cutters on an extended leg.

FIG. 5 shows a rock bit 500 with attached leg 508, cone 510 with attached inserts 512, and PDC cutters 560. The rock bit leg 508 extends down to slightly above the borehole bottom. Similarly, PDC cutters 560 extend to slightly above the borehole bottom 550, with PDC cutter 566 cutting the comer of the borehole. This design provides a PDC cutter as close as possible to the bottom of the borehole while nonetheless having teeth 512 ream the bottom of the borehole. However, PDC cutter 566 does not extend to the cutting tip of tooth 515. This ensures that the downward weight on bit (WOB) force is directed through the inserts and not through the PDC cutters 560.

Numerous variations are possible while still providing PDC cutters on the leg of a roller cone rock bit that are the primary cutting component at gage. For example, the cones are preferably designed with inserts that cut inboard of gage thus increasing the life of the outer row of inserts on the cones. FIG. 6A illustrates a cut-away view of a rock bit built in accordance with the principles of the invention. A plurality of inserts are mounted in leg 508. PDC cutters 603, 604 are mounted with their cutting tips extending to gage diameter. In contrast, PDC cutters 601, 602, 603, and 604 are mounted with their cutting tips not extending to gage diameter. FIG. 6B shows upper cutters 611–613 cutting to gage, with cutter 614 off gage and lowermost cutter 615 more off gage.

Figure 6C:
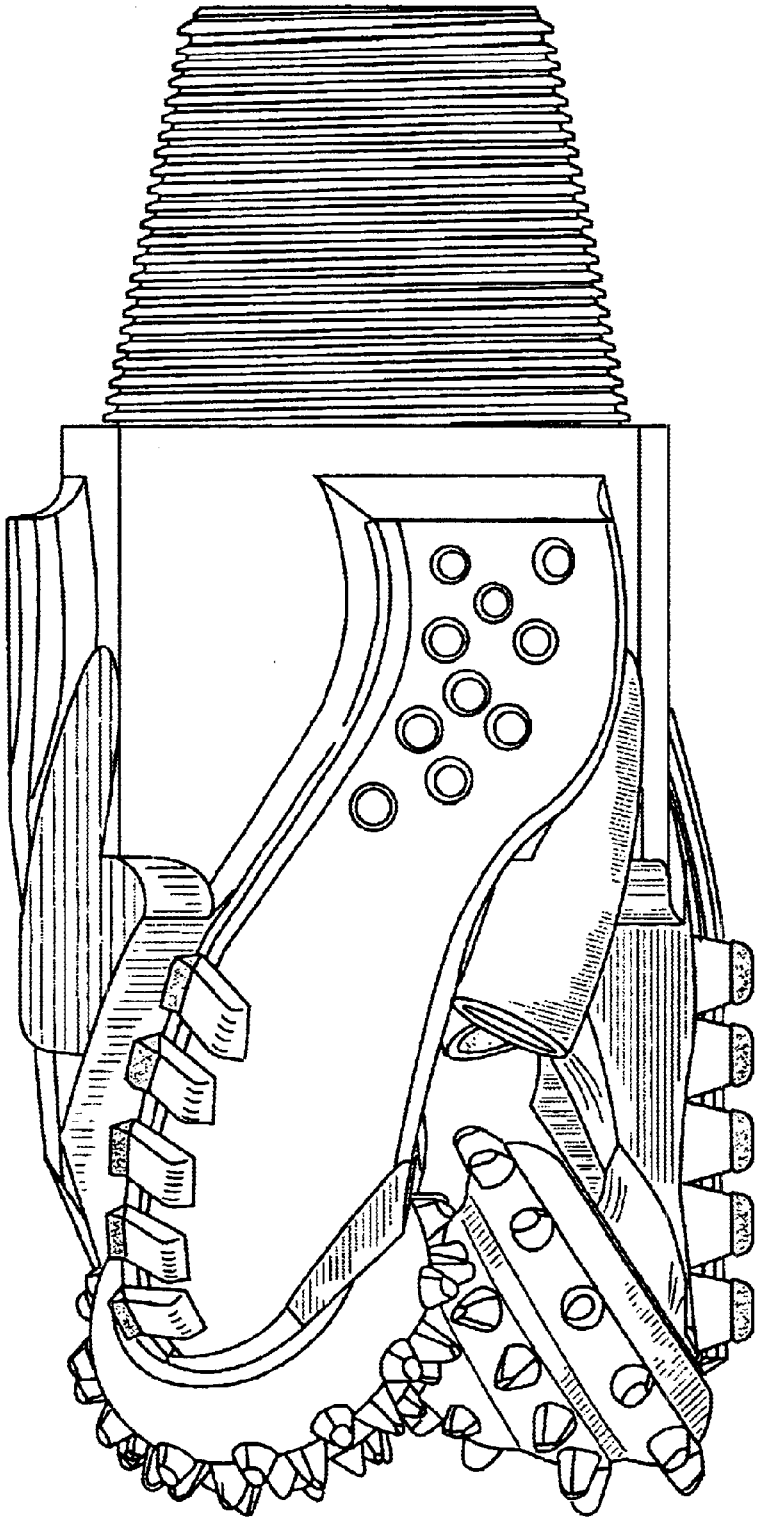
FIG. 6C shows a drill bit having milled tooth cutters.
Figure 6D:
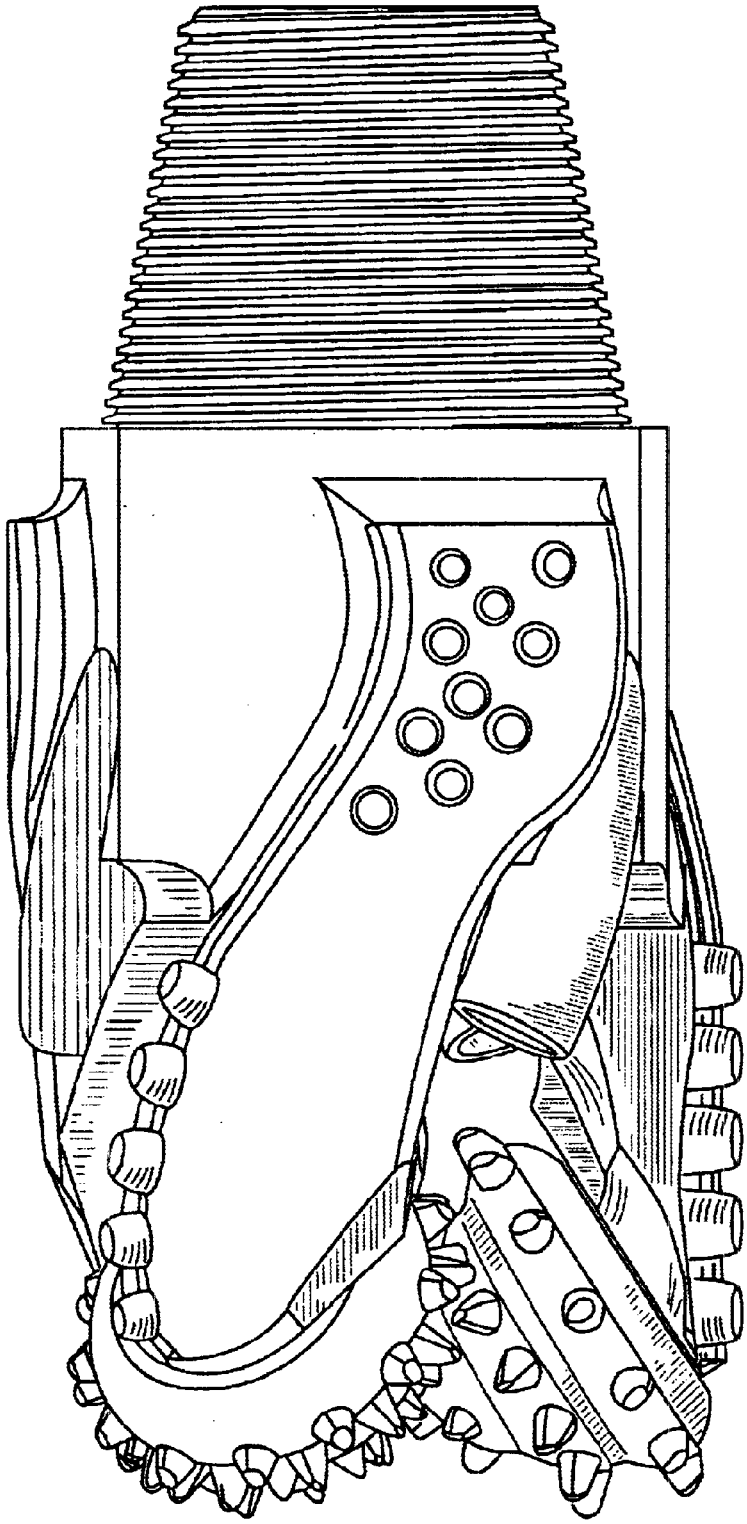
FIG. 6D shows a drill bit having TCI insert cutters.

As an alternative configuration, the PDC cutters 260 can be replaced with steel teeth on the leading side of the leg with applied hardfacing, as shown in FIG. 6C. The steel teeth could be milled into the forging, welded or otherwise attached to the leg. The PDC cutters could also be replaced with carbide insert or other hardened inserts with a cutting edge, as shown in FIG. 6D. An active cutting edge for a TCI insert would be defined by an insert that has a surface with a radius of curvature that is less than ½ the diameter of the insert. For example, chisel, conical, or sculptured inserts would all be considered as having an active cutting edge. However, semi-round-top inserts or flat top inserts pressed into the bit such that the flat face does not extend beyond the surface of the bit body, would be considered non-active cutting elements. An active cutting edge is also present where the cutting element is a steel tooth or a PDC insert because these elements are built to shear formation.

Another configuration within the scope of the invention would be the manufacture of cutting elements further back than the leading edge of the leg, so that an active cutting surface is presented to the borehole wall in a similar way as disclosed above, although this configuration is not preferred.

Referring back to FIG. 2, during operation, nozzle 230 directs drilling fluid toward the bottom of the borehole. This drilling mud flows around cone 210, cooling the inserts 212 that cut the rock formation downhole. Simultaneously, the drilling mud carries away the rock drillings created by the action of the inserts 212. The continued ejection of drilling fluid from nozzle 230 and the rotating action of the drill bit and cones 210 forces drilling fluid up against the mud lifter ramp 218 and PDC cutters 260. The drilling fluid then travels up toward the surface via mud ramp 218, which helps to create a stable fluid flow path to the surface. This stable fluid flow path minimize eddies, currents, and other flow inhibiting phenomena. Mud ramp 218 therefore provides a continuous channel from near the bottom of the wellbore to the top of the drill bit body.

The rock bit design may also be altered to emphasize the mud lifter ramp design and incorporate other inventive features. The rock bit of FIG. 7A includes a cylindrical drill bit body 10 that rotates about a longitudinal axis 18. Alternately, the body 10 may be conical or other appropriate revolved shape. Drill bit body 10 includes a threaded pin connection 16 with pin by shoulder 45 and a side face region 1 near the upper portion of the drill bit body 10. Each side face region 1 includes an array of inserts 5, whose outermost surface may extend to gage diameter or may extend under gage. A transition portion 11 exists between the side face region 1 and threaded connection 16, with a lubricant reservoir 17 being located on the transition region 11 above the side face region 1. Lubricant reservoir may be located not only on the top of the leg as shown but may alternately be located on the side of the leg.

Three legs 2 (only one is fully shown) are disposed below the side face region 1. Integrated nozzle 8 and nozzle boss 41 are formed from the leading leg. Similarly, leg 2 forms a nozzle 7 and nozzle boss (not fully shown). Each nozzle 7, 8 is in fluid communication with a plenum inside the drill bit body 10. The nozzles 7, 8 are positioned to spray drilling fluid 30 (also known as drilling mud) toward the bottom of the borehole. A single rotating cutter 4, with attached inserts 6 that penetrate and crush the borehole bottom, attaches to the bottom of each leg 2.

Each leg includes a leg backface 40 at a tapered angle a away from the gage diameter of the drill bit. Of course, angle $\alpha$ may be zero, resulting in a vertical side face. Each leg also includes a trailing side 42 and a leading side, with the leading side of leg 2 forming a mud lifter ramp 12. Mud lifter ramp 12 provides a surface upon which drilling fluid can be pumped up toward the surface and away from the proximity of the drill bit body 10. Preferably, at least two mud lifter ramps are to be used on a three cone rock bit. However, it should be understood that the mud ramp could be used on bits with two, four or more roller cones on the bit. A fluid channel 15, also called a junk slot, for drilling fluid is formed by the mud lifter ramp 12 of one leg and the sidewall of the nozzle boss 20 on the leg in front of it. Wear resistant inserts 13 are placed on the leg backface of each leg of the drill bit. Like inserts 5, inserts 13 may be either on or off gage. The inserts 5, 13 may be cutting or non-cutting, and may be made from any appropriate substance, including TCI, PDC, diamond, etc. The nozzle sidewall 20 may be vertical, or may be angled away from vertical. It may be straight, curved, or otherwise shaped to maximize desirable characteristics of the drill bit.

The mud lifter ramp 12 begins at its lower end at the leading side of the leg shirttail from the ball plughole area and moves up to the upper end of the leg. The mud lifter ramp 12 includes a rounded circular or semi-circular region 22 at its base, which is located as close to the hole bottom as feasible to result in an optimization of the lifting efficiency of the mud lifter ramp. In fact, if the side backface region is extended downward akin to that shown in FIG. 5, the mud ramp may begin very close to the bottom of the borehole. The semi-circular region 22 transitions to a first straight mud ramp region 23 further up the leg 2. A second, closer to vertical mud ramp region 24 is located above the first straight mud ramp region 23. Angle "A," measured with respect to a line 27 perpendicular to the longitudinal line 18, measures the angle of the first straight mud ramp region 23. Angle "B," also measured with respect to line 27, measures the angle of the second mud ramp region 24. Preferably, angle "A" is between 10° and 80° inclusive, and angle "B" is between 10° and 90° inclusive. Even more preferably, angle "B" is between 30° and 80°. Of course, the slope of the regions may also be expressed with respect to the longitudinal axis of the drill bit. It is to be understood, however, that the first and second straight mud ramp regions may in fact be curved. In addition, the mud ramp could be designed with increasing numbers of straight sections at which it would be configured with angles "A", "B", "C", "D", etc. Consequently, the surface of the mud ramp 12 can consist of several straight sections that change in angle from each other, as a continuously changing curve or as a complex curve that has both straight and curved sections together to result in a pumping of the drilling fluid up the drill bit as the drill bit rotates in the drilled hole. Junk slot 15 is preferably a large, open pocket formed between the mud lifter ramp 12 and the side of the nozzle boss 20 and its proximate region in the area of the cone cutters and it has a relatively flow-friendly size and shape. The junk slot 15 allows the fluid to flow easily around the bit, and is bounded on one side by mud ramp 12 and on the other by the outside surface of jet boss 20. The back (i.e. leading side) of the legs is shaped to act as a pump to carry cuttings up the hole and away from the bit. The cross-sectional area of fluid channel 15 is large due to the contours of the mud ramp 12 and the integration of nozzle 7 into the leading leg 2, resulting in the side face 20 for the nozzle boss being both a portion of the nozzle 7 and a wall for the leg 2, as well as serving as a wall for the fluid channel 15. This eliminates any recess or spacing between the leg and the nozzle body. In a particularly advantageous result for drilling fluid flow, the space savings from integrating the nozzles 7, 8 into respective legs 2 helps to enlarge the size of fluid channel 15.

Figure 11A:
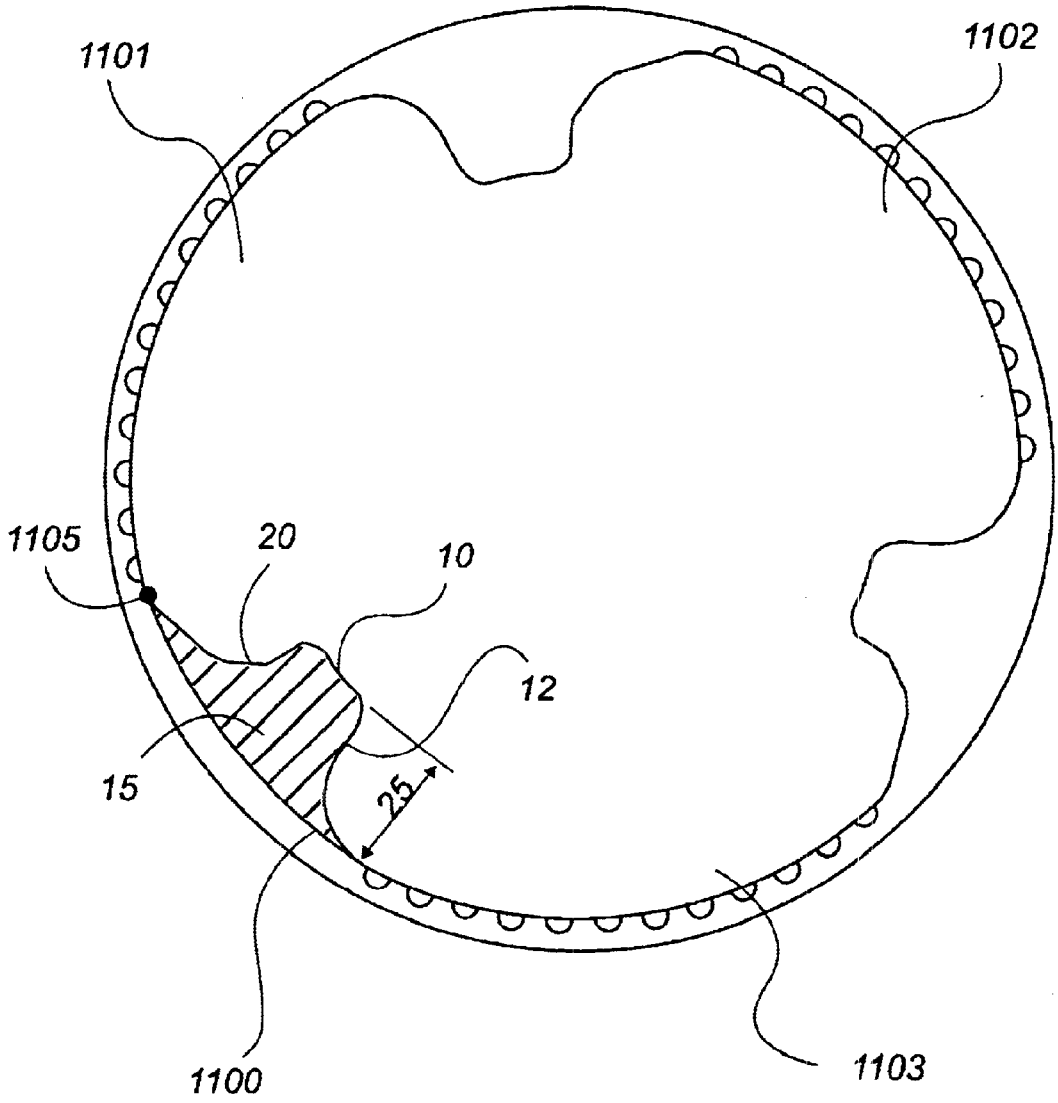
FIG. 11A is a cross-sectional view of the drill bit of FIG. 7A showing junk slot area.

Referring to FIG. 11A, a drill bit having three legs 1101, 1102, 1103 is shown. Inserted in each leg are numerous inserts. A junk slot 15 is formed from the mud ramp of leg 1103, the nozzle boss of leg 1101, and the portion of the drill bit body 10 between these two. For measurement of the cross-sectional area in FIG. 7A, the inside boundary of the junk slot is the drill bit body 10, with the mud ramp 12 and the nozzle boss 20 forming the rear and front boundaries. The outside boundary of junk slot 15 is a curved arc 1100 referred to as the junk slot boundary line. This junk slot boundary line 100 is formed at any specific height along the drill bit by the rotational movement of an outermost point 1105 on the leg 1101 at that height. The depth 25 of the mud ramp can be equal up to the distance between the pin shoulder and the side face of the drill bit, and is expected to be large enough to make the volume and contours of fluid channel 15 acceptable. For example, on a 8 ¾" bit, depth 25 may be 1.5". The cross sectional area of the junk slot 15 generally increases as the fluid moves upward from the bottom of the nozzle boss to the top of the mud ramp. For example, the cross-sectional area of the junk slot at the top may be from 15% to 600% greater than at the bottom. It is expected that an increase in cross-sectional area of at least 100% will be desirable in many applications.

Figure 11B:
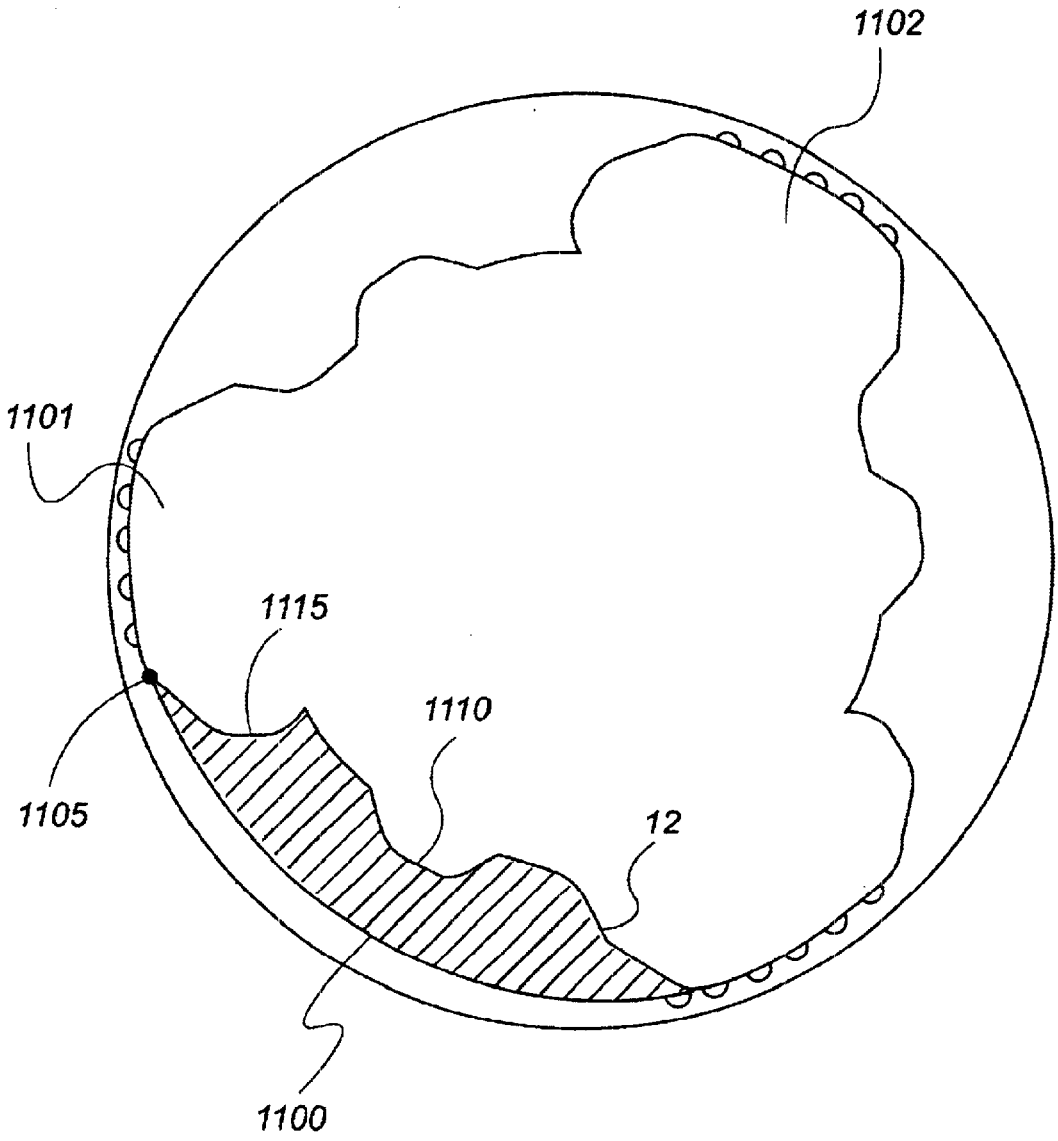
FIG. 11B is a cross-sectional view of an alternate drill bit showing junk slot area.

Referring back to FIG. 7A, the jet boss side wall 20 makes up the left side of the junk slot 15. However, the invention could also be practiced as shown in FIG. 11B. FIG. 11B shows a drill bit with a first leg 1101, a second leg 1102, and a third leg 1103. Between the first and second leg, a raised section is for the jet boss 1110, which is shown offset from gage. Jet boss 1110 is not integrated into an adjacent leg. In this case, the junk slot is bounded on one side by a mud ramp 12 and is bounded on another side by the edge of the leg shirt tail 1115. In such a case, the junk slot boundary line 1100 is calculated from an outside point 1105 of rotation on a relevant leg 1101 and extends all the way to the trailing leg 1103. Other drill bit designs may correspond to other junk slot boundary lines, as will be apparent to one of ordinary skill in the art.

During drilling of the borehole, the bit is rotated on the hole bottom by the drill string. Typical rotational rates vary from 80–2220 rpm. Nozzle 7 may eject drilling mud 30 toward the trailing edge of the rotating cones 4 and toward bottom of the borehole. This drilling fluid generally cools the cutting inserts 6 and washes away cuttings from the borehole bottom. Drilling mud 30 thus generally follows mud path 31 at the bottom of the borehole and mud path 32 through fluid channel 15. Alternately, nozzle 7 may eject drilling mud toward the leading edge of the cones 4, resulting in mud flowing up mud path 32. The drilling mud then travels toward the surface via the annulus formed between the drill string and the borehole wall. The design allows for the use of an improved jet bore that runs at an angle generally parallel to the slope of the channel on the backside of the leg. This allows for an improved directionality of the jet toward the cone to improve the removal of cuttings.

Figure 7A:
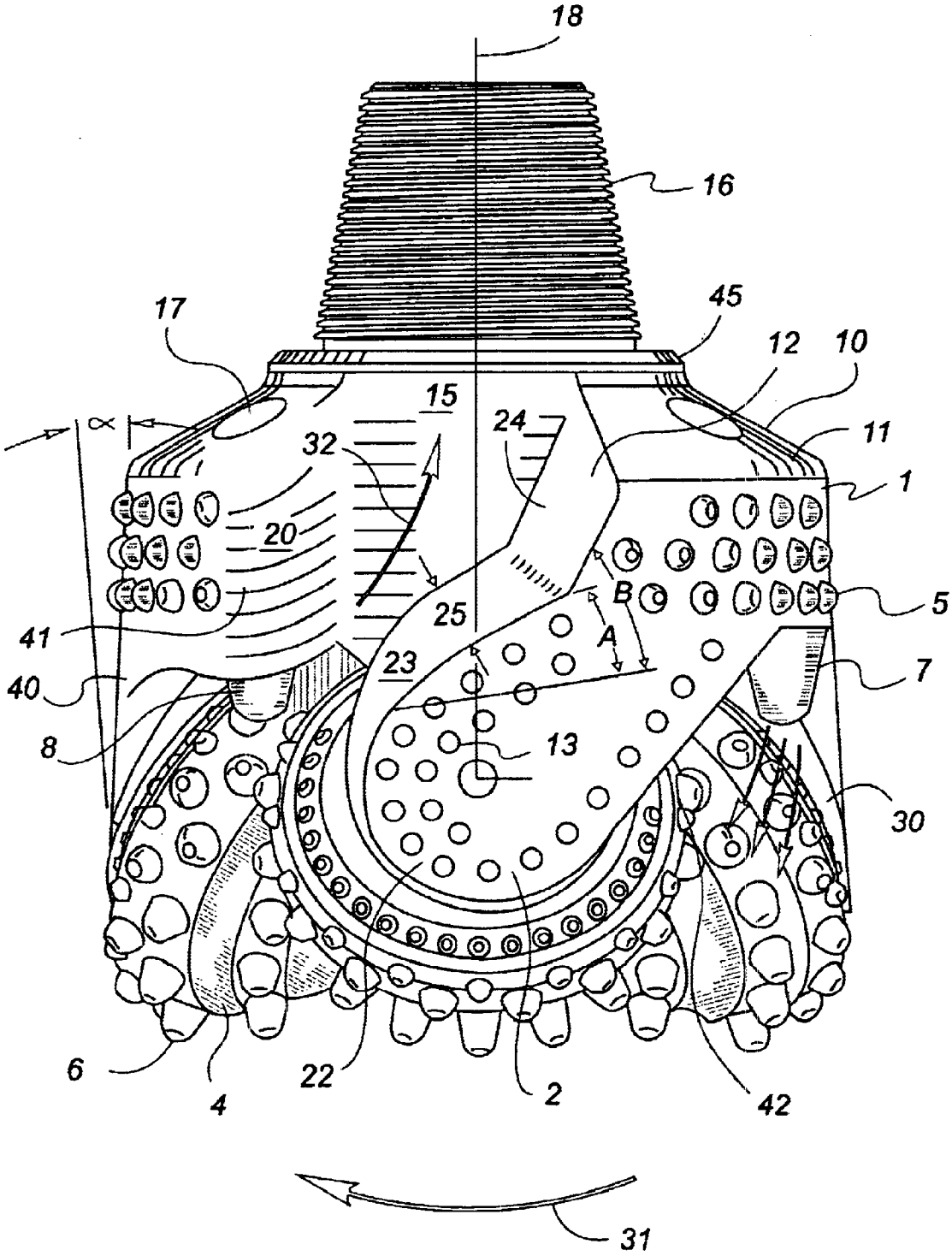
FIGS. 7A–7C is a view of a second embodiment of the invention including a mud lifter ramp on a leg of the drill bit.
Figure 10:
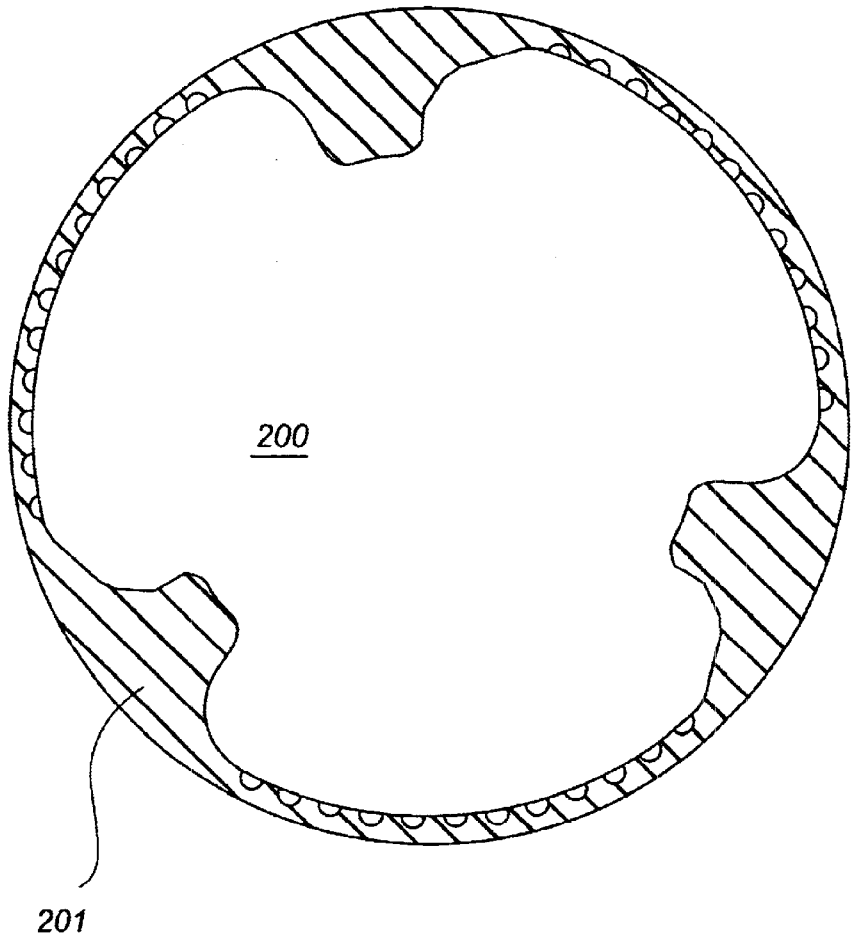
FIG. 10 is a cross-sectional view of the drill bit of FIG. 7A in a borehole showing annular area.

A benefit of the junk slot is that its increasing cross-section area generally corresponds to an increasing annular area as the fluid moves up the bit side wall. Thus, referring to FIG. 10, the annular area is defined by computing the cross sectional area of the drilled hole minus the cross sectional area of the outside surface of bit 200. The annular area 201 is available for cuttings to be evacuated around the bit. In FIG. 7A, the annular area continually increases from the bottom of the jet nozzle boss to the top of the mud ramp. The increasing cross sectional area of the junk slot, and the annulus, as the pin end of the roller cone rock bit is approached ensures that the mud ramp has a sufficient volume of fluid available to ensure an efficient pumping action as the bit rotates in the hole. This helps to prevent the regrinding of cuttings as they are more effectively moved from the hole bottom. It also helps to ensure that cutting move upward and don't conglomerate or "pack off" around the bit. This is particularly desirable when the bit is rotating at high rotational velocities in excess of 150 rpm and generating a high volume of cuttings.

Figure 7B:
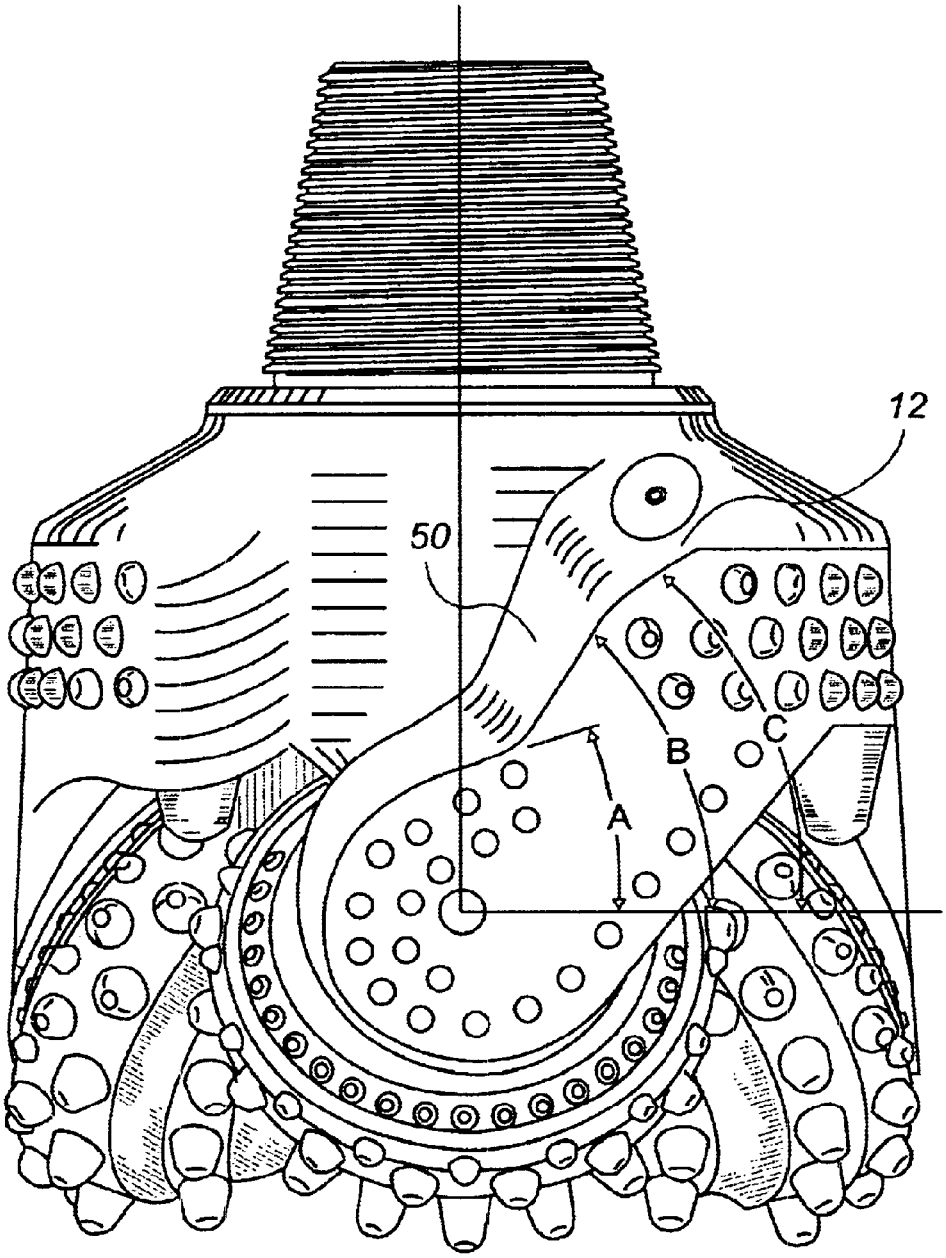
Figure 7C:
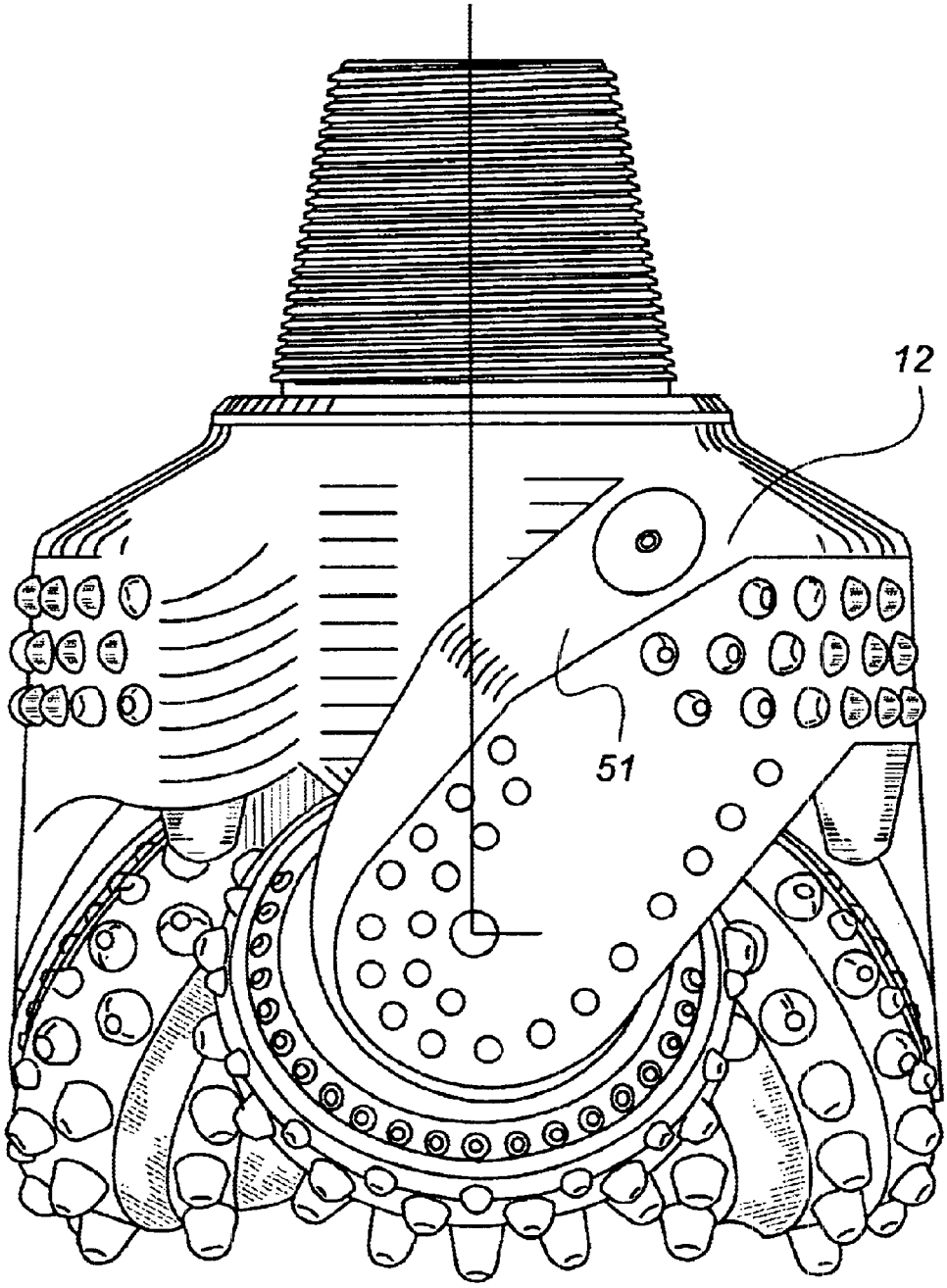

FIGS. 7B and 7C show alternative configurations for the mud ramp. FIG. 7B uses a three separate straight sections with angles A, B, and C to create ramp surface 50. FIG. 7C has a mud ramp with a convex slope making up ramp surface 51. Thus, the fluid channel and mud ramp creates a mud flow region that is expected to improve bottomhole cleaning, reduce hydrostatic pressure, improve the rate of penetration of the bit, and lengthen the life of the bit.

Figure 8A:
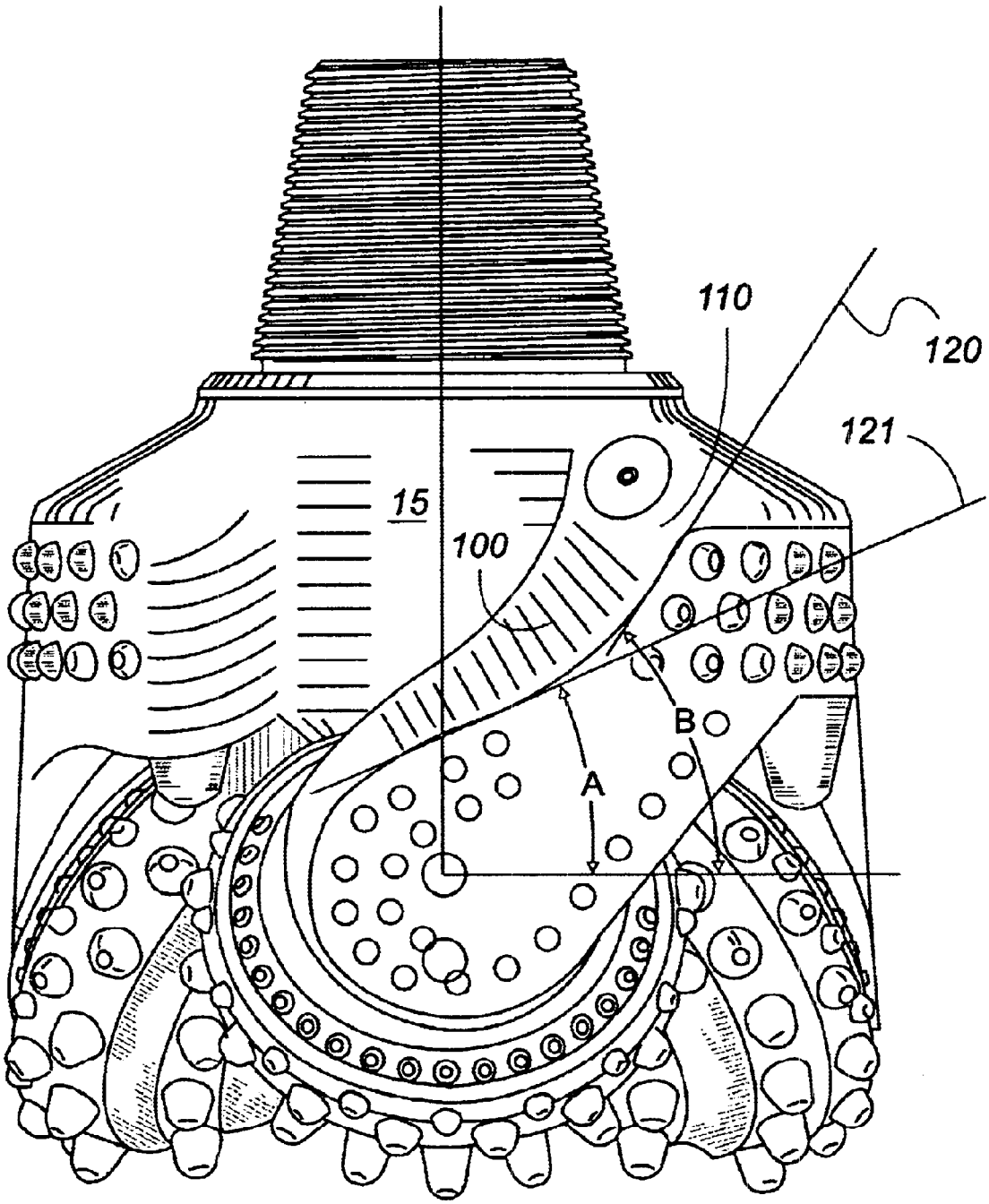
FIGS. 8A–8F show various configurations for the mud lifter ramp on the leg of a drill bit.

Rather than using a series of straight sections for the mud ramp as illustrated in FIG. 7A, the drill bit could also be designed as a set of continuous curves as shown in FIGS. 8A–8F. Referring to FIG. 8A, the mud ramp 110 is designed with a curved section. Angles A and B are measured to tangent lines 120 and 121 to a point on the curve. A tangent angle on the mud ramp curve is generally between 10° and 90°.

Figure 8B:
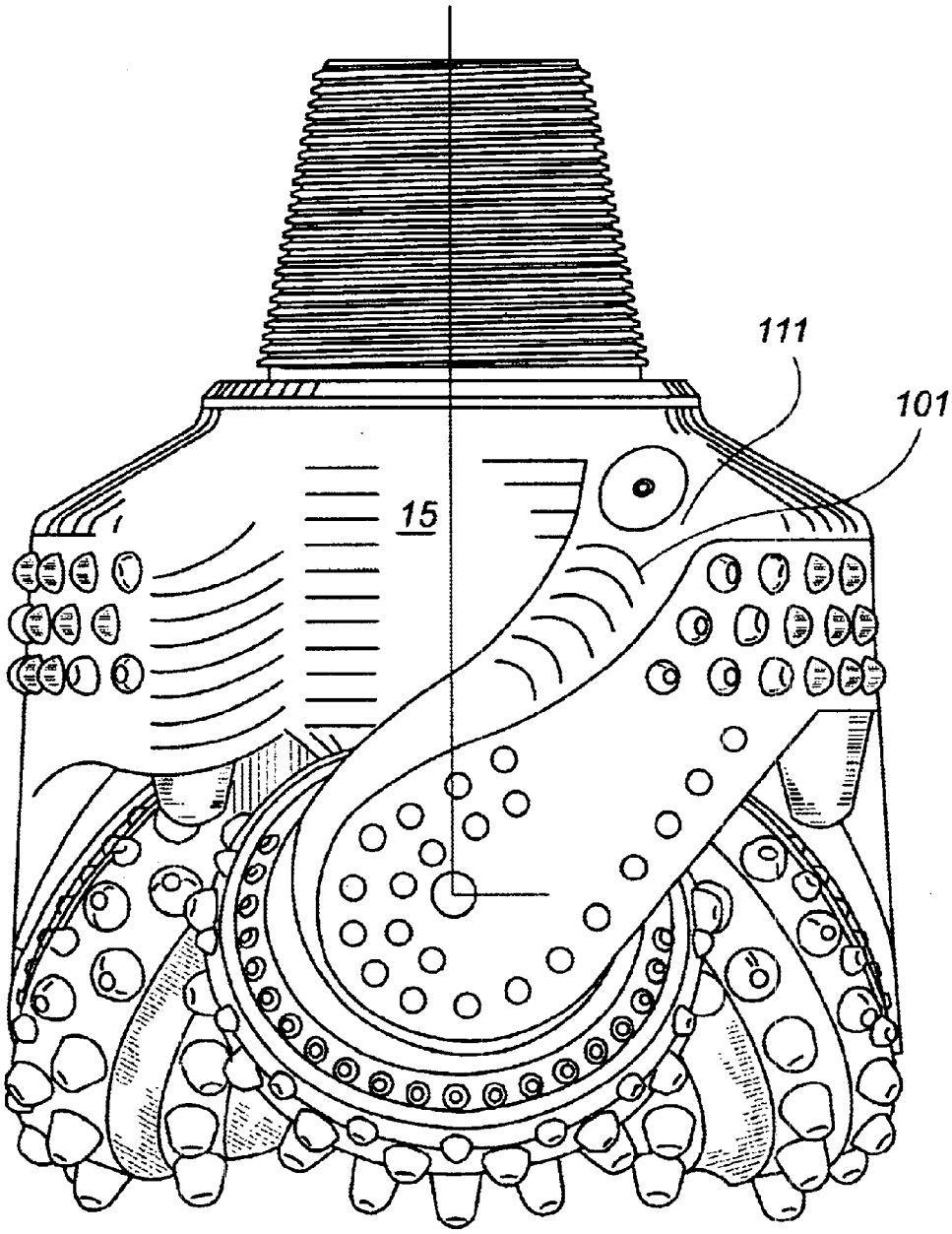
Figure 8C:
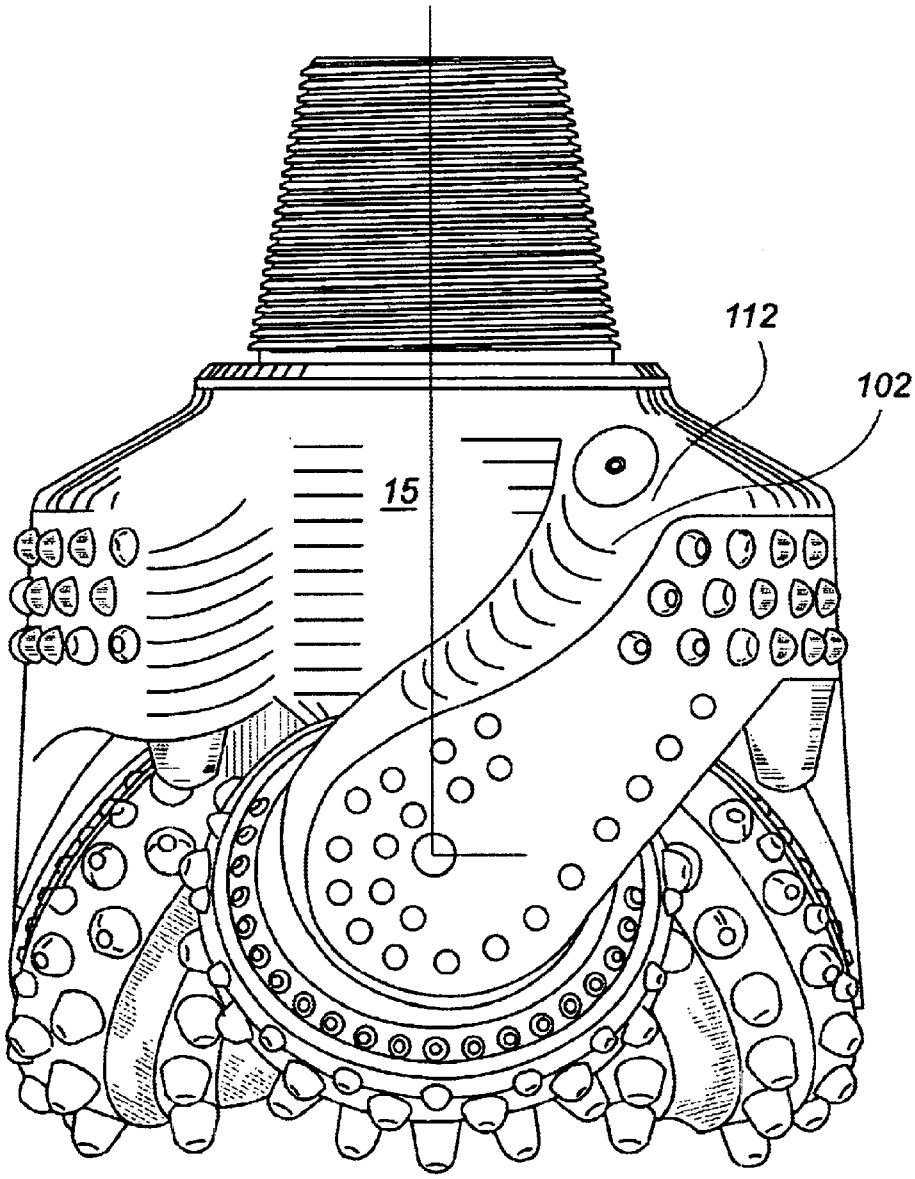
Figure 8D:
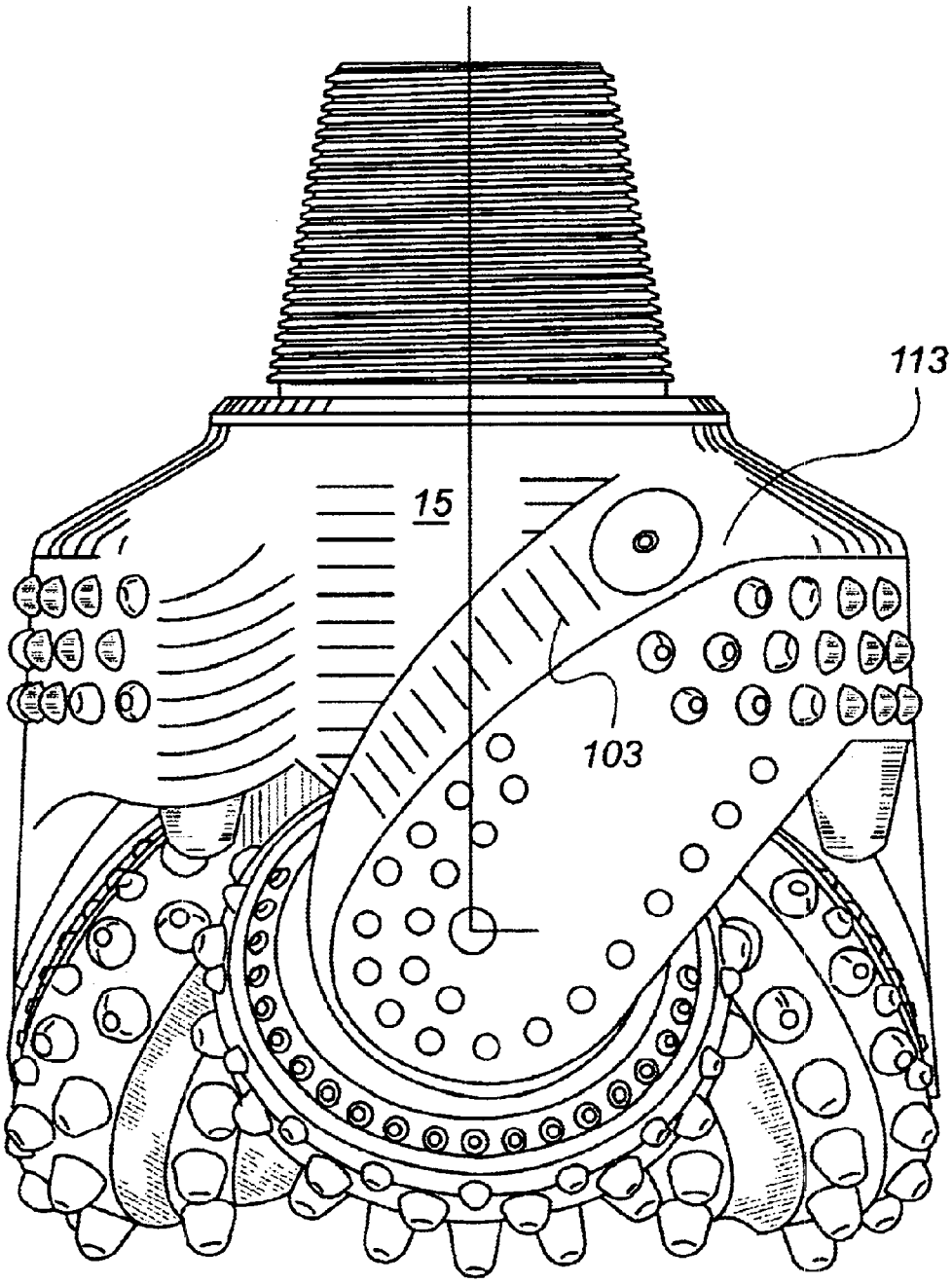
Figure 8E:
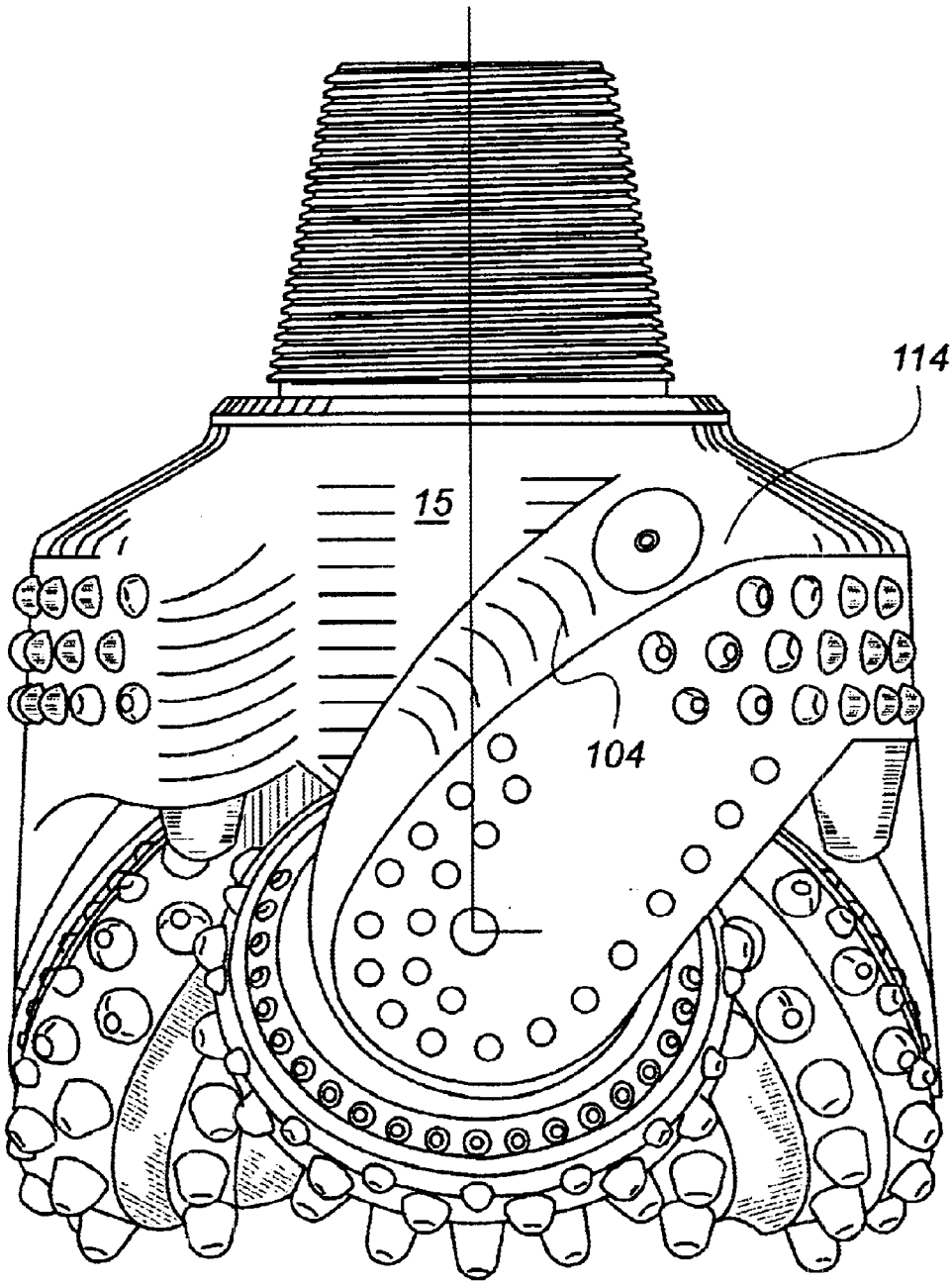
Figure 8F:
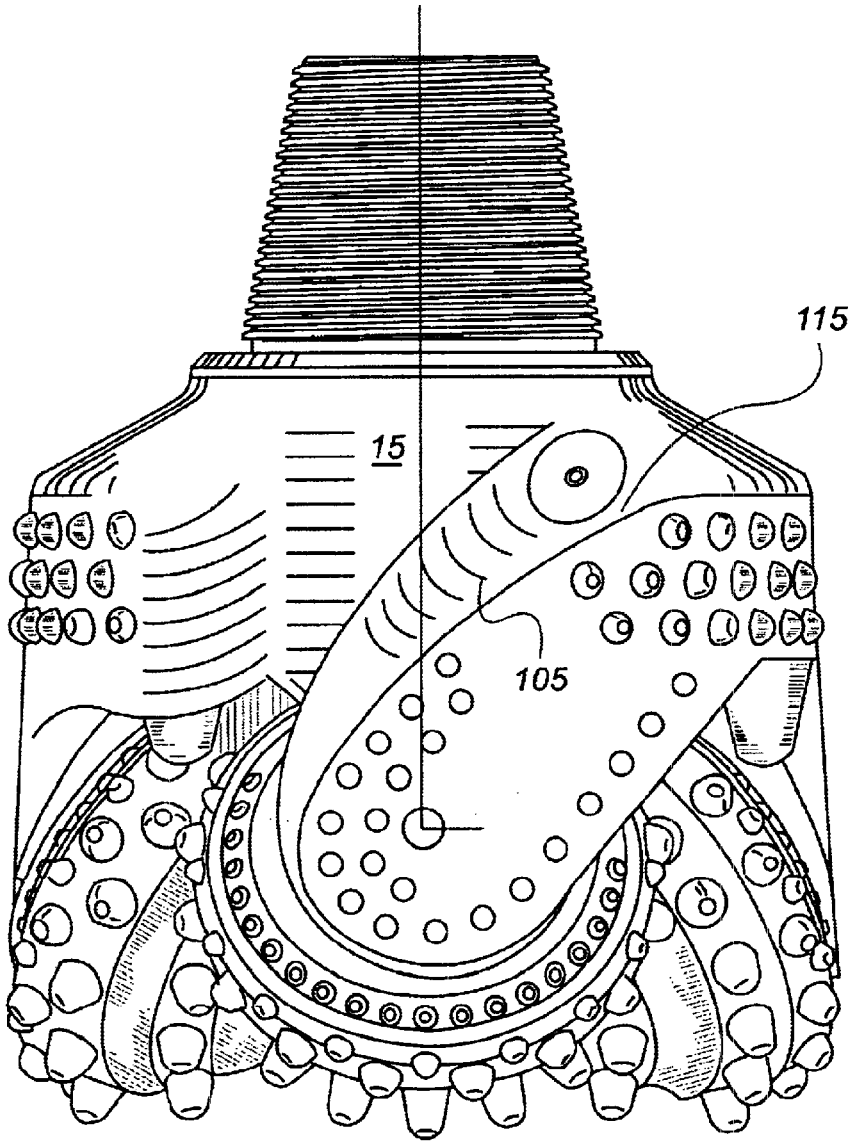

The ramp surface itself can also be concave, convex or flat. FIG. 8A–8F illustrate different combinations of ramp curvatures and ramp surfaces curvatures. FIG. 8A illustrates a concave ramp 110 with a flat ramp surface 100. FIG. 8B illustrates a concave ramp 111 with a concave ramp surface 101. FIG. 8C shows a concave mud ramp 112 with a convex ramp surface 102. FIG. 8D shows convex mud ramp 113 with a flat ramp surface 103. FIG. 8E shows a convex mud ramp 114 with a concave ramp surface 104 and FIG. 8F shows a convex mud ramp 115 with a convex mud ramp surface 105. In each instance, the annular cross sectional area is continually increasing as the fluid moves up the junk slot 15.

By providing a mud ramp and a large, convenient flow channel 15 for the flow of drilling fluid, the design is expected to reduce the level of hydrostatic pressure at the bottom of the borehole (by more effectively removing drilling mud from the bottom hole), allowing more net weight on bit (WOB) to be communicated to the drill bit. The force of the drilling mud downward on mud ramp 12 further increases net WOB. Moreover the generation of a reduced hole bottom pressure can reduce chip hold-down forces that can increase penetration rates by allowing cuttings to be more efficiently removed from the hole bottom. Furthermore, the hydrolifter design also reduces damage to the rock bit components such as cutting inserts 6 and nozzles 7 by more efficient removal of excess drill cuttings.

Figure 9A:
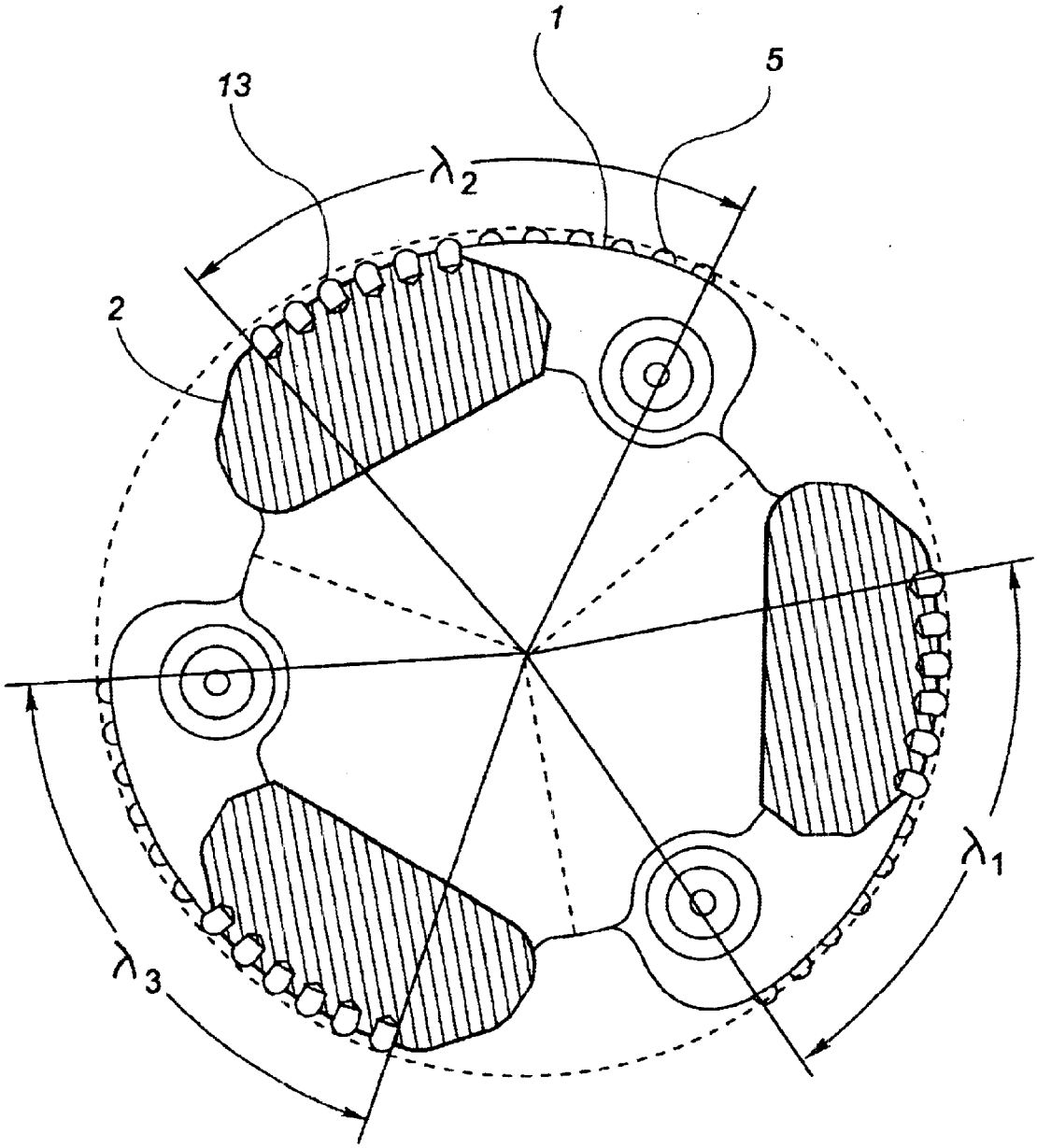
FIGS. 9A–9C show various on-gage and off-gage sidewall and leg inserts around the circumference of the bit.
Figure 9B:
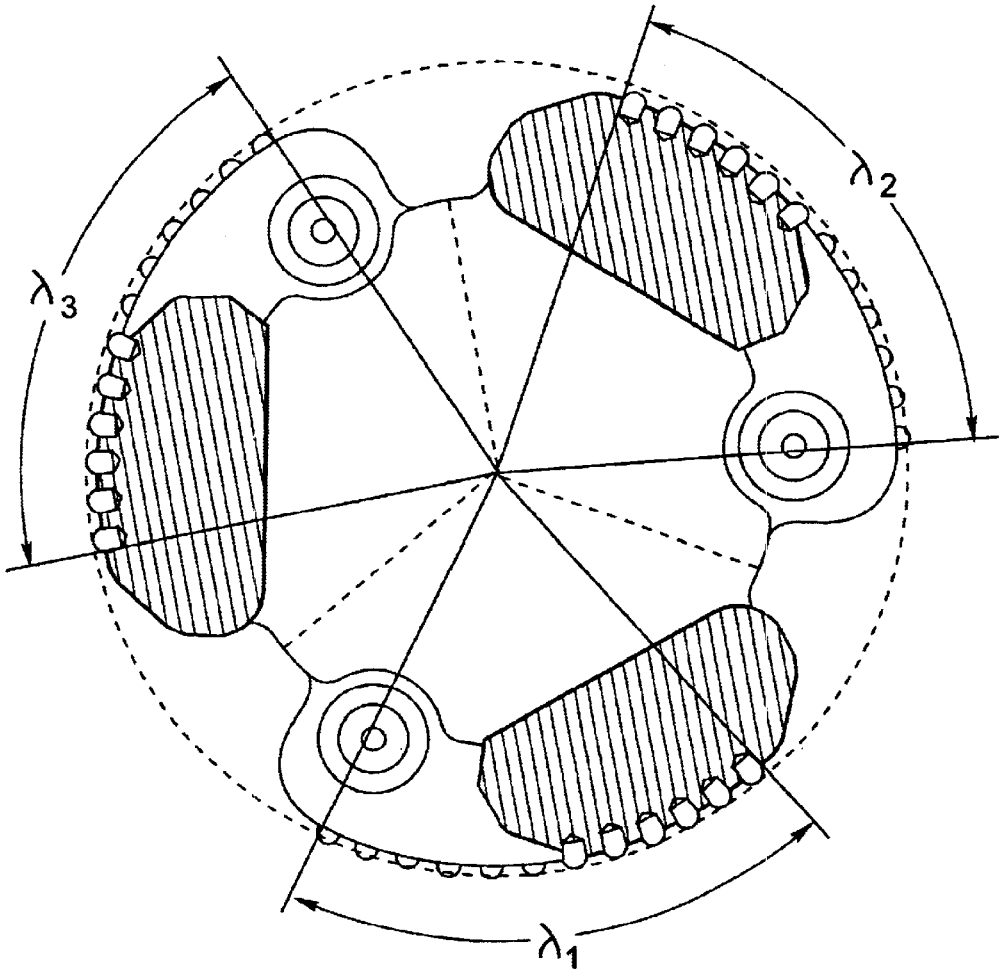
Figure 9C:
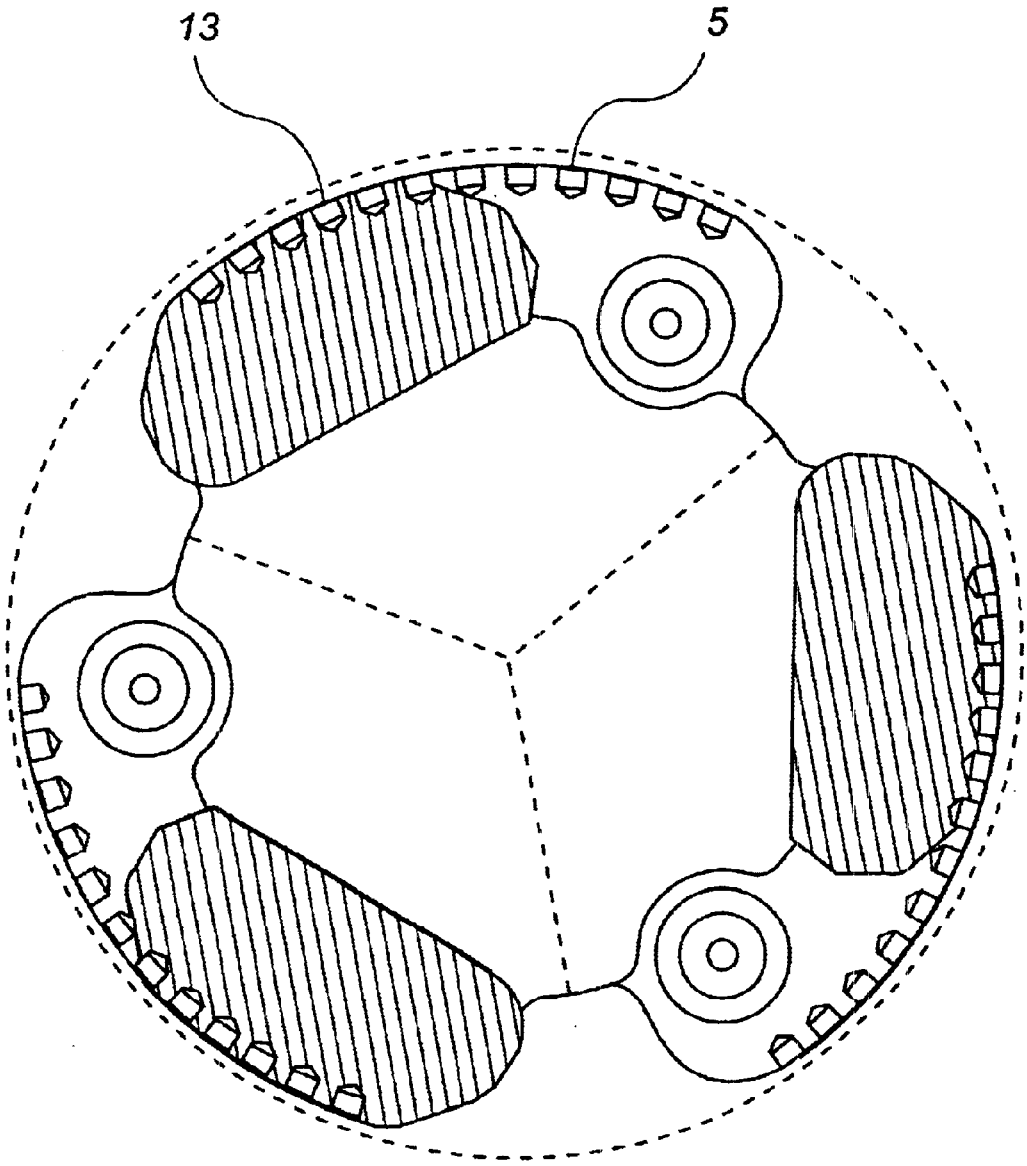

FIG. 9A is a top-down view of the drill bit of FIG. 7A. Angle $\lambda_1$ is the angular area occupied by the inserts on a first leg and associated side face region 1. Angle $\lambda_2$ is the angular area occupied by the inserts on a second leg and associated side face region 1. Angle $\lambda_3$ is the angular area occupied by the inserts on a third leg and associated side face region 1. The summation of $\lambda_1$, $\lambda_2$, and $\lambda_3$ gives the total angle of inserts located around the circumference of the bit. It is desirable to have 150° to 360° of inserts located around the circumference of the bit. It is more desirable to have 180° to 360° of inserts located around the circumference of the bit. These inserts provide stability to the bit as well as protect the surfaces of the leg and jet boss from erosion as they come in contact with the hole wall. Inserts 13 and 5 protrude from the back side of the leg 2 and side wall surface 1 and can help maintain the gage diameter of the hole wall by acting as reamers. Alternately, the inserts may be recessed or flush with the body of the drill bit. Either way, at each angular location around the drill bit body, preferably at least one point of either the inserts 5 embedded in the side face 1, or the inserts 13 in leg 2 on the drill bit body, is substantially at gage diameter, although the inserts 5, 13 may also be somewhat off-gage and still fall within the scope of this inventive feature as shown in FIG. 9B. The increased engagement of the drill bit inserts with the borehole sidewall stabilizes the drill bit. FIG. 9C shows side wall inserts 5 and leg insert 13 that are flush and off gage. While these do not provide the reaming capability of the inserts if FIGS. 9A and 9B, they do protect the mud ramp surfaces from erosion from the side to maintain the pumping efficiency.

In addition, increased engagement also improves the hydro-lifter performance of the drill bit. Referring back to FIG. 7A, transition region 11 prevents most of the drilling mud 30 from recycling down to the bottom of the borehole. To the extent mud flows around the outside of drill bit body 10 toward the borehole bottom, numerous inserts 5 disrupt the flow of drilling mud that flows over transition region 11. This helps to prevent drilling mud 30 from recycling down to the bottom of the borehole.

Various portions or components on the drill bit may also be hardfaced to resist wear. Each side face and the leading edge of each leg is also preferably hardfaced to resist wear. The mud lifter ramps may also be hardfaced.

The drill bit of FIG. 7A may be constructed in various ways. For example, the drill bit body may be a single body with the mud lifter ramps being machined into the body of the drill bit. Alternately, the drill bit body may consist of a number of segmented legs, with the leg sections being bolted or welded together to form a bit body. The body could also be constructed from a cast bit body and forged legs with the legs being welded or bolted to the cast body. Further, while the embodiments shown in the attached figures use TCI inserts on the cones, these features would work as well on roller cone rock bits designed with steel tooth cones.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is hot limited to the embodiments described herein, but is only limited by the claims that follow, the scope of which shall include all equivalents of the subject matter of the claims.

What is claimed is:

1. A rolling cone rock bit, comprising:

a drill bit body defining a gage diameter at which the rolling cone rock bit is designed to cut a borehole;

a first leg on said drill bit body, said first leg having a leg backface;

a rolling cone attached to said first leg at said lower end of said drill bit body, said rolling cone including a plurality of rolling cone cutters, none of said rolling cone cutters extending to said gage diameter;

a first plurality of cutting elements mounted on said leg backface of said first leg, said plurality of cutting elements having at least one cutting element with a cutting tip that extends to said gage diameter.

2. The rolling cone rock bit of claim 1, wherein said plurality of cutting elements arc disposed in a curved row on said first leg.

3. The rolling cone rock bit of claim 1, wherein a majority of said first plurality of cutting elements have cutting tips that extend to gage diameter.

4. The rolling cone rock bit of claim 1, wherein said plurality of cutting elements are disposed on a leading edge of said first leg.

5. The rolling cone rock bit of claim 4, further comprising:

a second leg on said drill bit body, said second leg having a leg backface;

a rolling cone attached to said second leg at said lower end of said drill bit body;

a second plurality of cutting elements mounted on said leg backface of said second leg, said second plurality of cutting elements having at least one cutting element with a cutting tip that extends to said gage diameter.

6. The rolling cone rock bit of claim 5, wherein said first plurality of cutting elements is staggered with respect to said second plurality of cutting elements when said first plurality and second plurality are placed in rotated profile to result in an overlap between every cutting element of said first plurality of cutting elements with cutting elements of said second plurality of cutting elements.

7. The rolling cone rock bit of claim 1, wherein said first leg includes a leading edge having a lower region extending from proximate said lower end of said drill bit and an upper end, said leading edge having a first portion disposed from said drill bit's longitudinal axis at a first angle, whereby said leading edge provides a surface for the flow of drilling fluid from the bottom of a wellbore.

8. The rolling cone rock bit of claim 1, further comprising:

a leading edge for said first leg;

a nozzle boss having a nozzle boss lower end and a nozzle boss upper end;

a fluid flow channel formed from said leading edge and said nozzle boss, the cross-sectional area of said fluid flow channel being greater at said nozzle boss upper end than at said nozzle boss lower end.

9. The rolling cone rock bit of claim 1, wherein said first plurality of cutting elements are polycrystalline diamond cutters.

10. The rolling cone rock bit of claim 1, wherein said first plurality of cutting elements are steel teeth.

11. The rolling cone rock bit of claim 10, wherein said steel teeth are coated with a wear resistant material.

12. The rolling cone rock bit of claim 1, wherein said first plurality of cutting elements are carbide inserts.

13. The rolling cone rock bit of claim 1, wherein said drill bit body has a circumference of 360 degrees, at least 150 degrees around the circumference of said drill bit body being covered by inserts disposed on the outer periphery of said drill bit body.

14. The rolling cone rock bit of claim 13, wherein a majority of said inserts extend to gage diameter.

15. The rolling cone rock bit of claim 13, wherein a majority of said inserts do not extend to gage diameter.

16. The rolling cone rock bit of claim 13, wherein at least 180 degrees of said circumference of said drill bit body is covered by said inserts disposed on the outer periphery of said drill bit body.

17. The rolling cone rock bit of claim 13, wherein at least 200 degrees of said circumference of said drill bit body is covered by said inserts disposed on the outer periphery of said drill bit body.

18. The rolling cone rock bit of claim 1, wherein said first plurality of cutting elements is not arranged along a leading edge of said first leg.

19. The rolling cone rock bit of claim 1, further comprising:

a second leg on said drill bit body, said second leg having a leg backface;

a rolling cone attached to said second leg at said lower end of said drill bit body, said rolling cone attached to said second leg including a second plurality of rolling cone cutters, none of said second plurality of rolling cone cutters extending to said gage diameter;

a second plurality of cutting elements mounted on said leg backface of said second leg, said second plurality of cutting elements having at least one cutting element with a cutting tip that extends to gage diameter.

20. The rolling cone rock bit of claim 1, wherein not all of said first plurality of cutting elements extend to gage diameter.

21. The rolling cone rock bit of claim 1, wherein said plurality of cutting elements are arranged in a sharp curve to assist in the cutting of formation.

22. The rolling cone rock bit of claim 1, said first leg including a curved leading edge and said first plurality of cutting elements being arranged perpendicular to the curve of said leading edge.

23. The rolling cone rock bit of claim 1, said first leg including a leading edge and wherein said drill bit body defines a longitudinal axis and said leading edge is curved, said first plurality of cutting elements being arranged perpendicular to said longitudinal axis.

24. The rolling cone rock bit of claim 13, wherein said inserts act as reamers to maintain the gage diameter of the hole wall.

25. The rolling cone rock bit of claim 13, wherein said inserts are not reamers.

26. A rolling cone rock bit, comprising:

a drill bit body defining a gage diameter at which the rolling cone rock bit is designed to drill a borehole;

a first leg on said drill bit body, said first leg having a leading edge with a first portion and a second portion, wherein said first portion of said leading edge of said first leg is disposed at a first non-zero angle from a longitudinal axis of said drill bit body, and wherein said second portion is disposed at a second non-zero angle from said longitudinal axis, said first portion and said second portion being at different angles such that said first leg has both leading and lagging regions;

a rolling cone attached to said first leg at a lower end of said drill bit body;

at least one cutting element on said first portion of said leading edge of said first leg, said at least one cutting element on said first portion extending to said gage diameter;

at least one cutting element on said second portion of said leading edge of said first leg, said at least one cutting element on said second portion extending to said gage diameter.

27. The rolling cone rock bit of claim 26, wherein said rolling cone includes a plurality of cutting teeth extending to said gage diameter.

28. The rolling cone rock bit of claim 26, further comprising:

a second leg on said drill bit body, said second leg having a leading edge;

a plurality of cutting elements on said leading edge of said second leg, said plurality of cutting elements on said second leg extending to said gage diameter; and wherein said at least one cutting element on said first portion of said first leg is staggered in rotated profile to said plurality of cutting elements on said second leg.

29. The rolling cone rock bit of claim 26, wherein said leading edge forms a surface for the flow of drilling fluid from the bottom of said borehole.

30. The rolling cone rock bit of claim 26, wherein said leading edge is curved.

31. The rolling cone rock bit of claim 26, wherein said leading edge is curved and said leading edge forms a surface for the flow of drilling fluid from the bottom of said borehole.

32. The rolling cone rock bit of claim 26, wherein said rolling cone rock bit includes an adequate number of cutting elements along said leading edge at gage diameter so that the rock reams to gage diameter for the life of the rock bit.

33. The rolling cone rock bit of claim 26, wherein said leading edge is a sharp curve.

34. The rolling cone rock bit of claim 26, wherein said leading edge is curved and said at least one cutting element on said first portion of said leading edge is perpendicular to said curve.

35. The rolling cone rock bit of claim 26, said drill bit body defining a longitudinal axis and wherein said at least one cutting element on said first portion is perpendicular to said longitudinal axis.

36. The rolling cone rock bit of claim 26, further comprising:

a rolling cone attached to said first leg, said rolling cone including a plurality of rolling cone cutters, at least one of said rolling cone cutters extending to gage diameter.

37. The rolling cone rock bit of claim 26, wherein not all of the cutting elements on said leading edge of said first leg extend to gage diameter.

38. The rolling cone rock bit of claim 26, wherein said first portion is part of a straight mud flow ramp.

39. The rolling cone rock bit of claim 26, wherein said first portion is part of a first straight region and said second portion is part of a second straight region.

40. The rolling cone rock bit of claim 26, wherein said leading edge includes a first straight portion and a second straight portion.

41. The rolling cone rock bit of claim 26, wherein said leading edge is curved and all cutting elements on said first and second portions of said leading edge are perpendicular to said curve.

42. The rolling cone rock bit of claim 26, said drill bit body defining a longitudinal axis and wherein all elements on said first and second portions are perpendicular to said longitudinal axis.

43. The rolling cone rock bit of claim 26, wherein said at least one cutting element on said first portion is a steel tooth.

44. A rolling cone rock bit, comprising:

a drill bit body defining a gage diameter at which the rolling cone rock bit is designed to drill a borehole;

a first leg on said drill bit body, said first leg having a leading edge;

a rolling cone attached to said first leg at a lower end of said drill bit body;

at least one cutting element on said leading edge of said first leg, said at least one cutting element extending to said gage diameter, wherein said rolling cone does not include any cutting element extending to said gage diameter.

45. A rolling cone drill bit, comprising:

a drill bit body defining a gage diameter at which the drill bit is designed to drill a borehole, said drill bit body defining a longitudinal axis;

a first leg on said drill bit body, said first leg having a leading edge;

a first cutting element on said leading edge of said first leg that extends to gage diameter;

a second cutting element on said first leg that extends to gage diameter;

a third cutting element on said first leg that extends to gage diameter;

said first, second, and third cutting elements defining a non-straight active cutting surface;

a second leg on said drill bit body, said second leg having a leading edge;

a plurality of cutting elements on said leading edge of said second leg, said plurality of cutting elements on said second leg extending to said gage diameter; and wherein said first cutting element on said first leg is staggered in rotated profile to said plurality of cutting elements on said second leg.

46. A rolling cone drill bit, comprising:

a drill bit body defining a gage diameter at which the drill bit is designed to drill a borehole, said drill bit body defining a longitudinal axis;

a first leg on said drill bit body, said first leg having a leading edge;

a first cutting element on said first leg that extends to gage diameter;

a second cutting element on said first leg that extends to gage diameter;

a third cutting element on said first leg that extends to gage diameter;

said first, second, and third cutting elements defining a non-straight active cutting surface; and a rolling cone attached to said first leg, wherein said rolling cone does not include any cutting element extending to said gage diameter.

47. A rolling cone drill bit, comprising:

a drill bit body defining a gage diameter at which the drill bit is designed to drill a borehole, said drill bit body defining a longitudinal axis;

a first leg on said drill bit body, said first leg having a curved leading edge;

a first cutting element on said first leg that extends to gage diameter;

a second cutting element on said first leg that extends to gage diameter;

a third cutting element on said first leg that extends to gage diameter;

said first, second, and third cutting elements defining a non-straight active cutting surface, wherein said cutting elements on said first leg are perpendicular to said curve.

48. A rolling cone drill bit, comprising:

a drill bit body defining a gage diameter at which the drill bit is designed to drill a borehole, said drill bit body defining a longitudinal axis;

a first leg on said drill bit body, said first leg having a leading edge, said leading edge not being straight;

a cutting element on said first leg that extends to gage diameter, wherein said drill bit body has a circumference of 360 degrees, at least 150 degrees around the circumference of said drill bit body being covered by inserts disposed on the outer periphery of said drill bit body.

49. The rolling cone rock bit of claim 48, wherein a majority of said inserts extend to gage diameter.

50. The rolling cone rock bit of claim 48, wherein a majority of said inserts do not extend to gage diameter.

* * * * *